US007059803B2

(12) United States Patent
Floe et al.

(10) Patent No.: US 7,059,803 B2
(45) Date of Patent: Jun. 13, 2006

(54) POWERED BOATLIFT WITH ELECTRONIC CONTROLS

(75) Inventors: Wayne G. Floe, 48473 State Hwy 65, McGregor, MN (US) 55760; Daniel C. Myers, Palisade, MN (US)

(73) Assignee: Wayne G. Floe, McGregor, MN (US)

( * ) Notice: Subject to any disclaimer, the term of this patent is extended or adjusted under 35 U.S.C. 154(b) by 0 days.

(21) Appl. No.: 10/645,245

(22) Filed: Aug. 21, 2003

(65) Prior Publication Data

US 2004/0035343 A1 Feb. 26, 2004

Related U.S. Application Data

(60) Provisional application No. 60/405,283, filed on Aug. 22, 2002.

(51) Int. Cl.
*B63C 3/06* (2006.01)

(52) U.S. Cl. ..... 405/3; 405/4; 114/44; 114/48

(58) Field of Classification Search ..... 405/3, 405/4; 114/44, 45, 48, 51
See application file for complete search history.

(56) References Cited

U.S. PATENT DOCUMENTS

| | | | | |
|---|---|---|---|---|
| 2,307,420 | A | | 1/1943 | Mead |
| 2,529,948 | A | | 11/1950 | Jones |
| 2,562,189 | A | | 7/1951 | Harris |
| 2,589,882 | A | | 3/1952 | Sinner et al. |
| 3,077,742 | A | | 2/1963 | Brown |
| 3,139,732 | A | | 7/1964 | Thompson |
| 3,169,644 | A | | 2/1965 | Godbersen |
| 3,177,668 | A | | 4/1965 | Schneider et al. |
| 3,265,024 | A | | 8/1966 | Kramlich |
| 3,275,167 | A | | 9/1966 | Godbersen |
| 3,284,052 | A | | 11/1966 | Godbersen |
| 3,409,153 | A | | 11/1968 | Stearn et al. |
| 3,528,563 | A | * | 9/1970 | Valory et al. ..... 414/23 |
| RE27,090 | E | | 3/1971 | Rutter |
| 3,640,403 | A | | 2/1972 | Godbersen |
| 3,654,885 | A | | 4/1972 | Godbersen |
| 3,675,258 | A | | 7/1972 | Osmundson |
| 3,683,838 | A | | 8/1972 | Godbersen |
| 3,697,048 | A | | 10/1972 | Sarno |
| 3,757,962 | A | | 9/1973 | Chavet |

(Continued)

FOREIGN PATENT DOCUMENTS

JP 50319373 * 12/1993 ..... 405/3

*Primary Examiner*—Jong-Suk (James) Lee
(74) *Attorney, Agent, or Firm*—Charles A. Johnson

(57) ABSTRACT

A boatlift leg and frame structure utilizing a ball screw lifting mechanism driven by a reversible electric motor to raise and loser a boat support carriage. The raising and lowering operation of the ball screw mechanism is controlled by electronic circuitry that includes wired and remote direction selection; lifting logic with conflict detection and direction reversal delay; lighting control logic; motor power control; and overload detection logic to detect lifting overload and disable power to the motor power control. A drive train mechanism converts high-speed low torque rotation of the motor drive shaft to low-speed high-torque rotation drive of the ball screw. A boatlift leveling mechanism associated with one or more legs of the boatlift includes a ground engaging footpad, an extendible leg, a height adjusting screw mechanism and a height adjusting actuator with mating bevel gears coupled to the height adjusting screw for allowing adjustment through the side of a boatlift leg.

24 Claims, 16 Drawing Sheets

U.S. PATENT DOCUMENTS 3,865,223 A 2/1975 Godbersen
3,895,592 A 7/1975 King
3,905,499 A 9/1975 Speidel
3,911,980 A * 10/1975 McColl ..... 414/23
4,027,492 A 6/1977 Carpenter
4,072,119 A 2/1978 Williams
4,109,896 A 8/1978 Ragen
4,126,006 A 11/1978 Lewis
4,174,187 A 11/1979 Parisien
4,195,948 A 4/1980 Vancil
4,280,429 A 7/1981 Wells
4,287,625 A 9/1981 Dawson
4,318,632 A 3/1982 Fortmeyer
4,363,284 A 12/1982 Monroe
4,391,550 A 7/1983 Rutter
4,401,335 A 8/1983 Godbersen
4,432,664 A 2/1984 Baldyga
4,482,268 A 11/1984 Stevenson et al.
RE32,118 E 4/1986 Godbersen
4,595,313 A 6/1986 Kotke
4,641,596 A 2/1987 Reprogle et al.
4,641,996 A 2/1987 Seal
4,653,769 A 3/1987 Kenney et al.
4,678,366 A 7/1987 Williamson
4,763,593 A 8/1988 Lasko
4,764,081 A 8/1988 Peterson
4,832,210 A 5/1989 Wood, II
5,482,401 A 1/1996 Spisak
5,522,671 A * 6/1996 Keesling ..... 405/3
5,593,247 A * 1/1997 Endres et al. ..... 405/3
5,655,850 A * 8/1997 Holmgren ..... 405/3
5,772,360 A * 6/1998 Wood, II ..... 405/3
5,908,264 A * 6/1999 Hey ..... 405/3
6,174,106 B1 * 1/2001 Bishop et al. ..... 405/3
6,230,639 B1 * 5/2001 McLaughlin et al. ..... 114/44
6,408,776 B1 * 6/2002 McLaughlin et al. ..... 114/44
6,554,533 B1 * 4/2003 Godbersen ..... 405/3
6,695,533 B1 * 2/2004 Bulmann ..... 405/3

* cited by examiner

| | | |
|---|---|---|
| 1 | COVER, FLOE PLASTIC | 32 |
| 1 | GEAR BOX, BALL SCREW | 120 |
| 1 | HOUSING, COUPLER – BALL SCREW | 124 |
| 1 | PLATE, CONNECTOR | 122 |
| 1 | MOTOR, BOAT LIFT | 126 |
| 2 | SOLENOID, MOTOR CONTROL UNIT | 132/134 |
| 1 | CIRCUIT BREAKER, THERMAL SDLA–120 | 140 |
| 1 | INSULATOR, RESISTOR | 158 |
| 1 | RESISTOR | 156 |
| 1 | CONNECTOR, EDGE | 136 |
| 1 | BOARD, PC | 138 |
| 1 | SOCKET, CIGARETTE 12V | 146 |
| 1 | BREAKER, CIRCUIT – LIGHTING | 150 |
| 1 | SWITCH, LIMIT | 152 |
| 1 | SPROCKET, LARGE | 216 |
| 1 | SPROCKET, SMALL | 206 |
| 1 | CHAIN | 218 |
| 1 | PULLEY, 12" | 194 |
| 1 | HUB, BRAKE DISC | 190 |
| 1 | V–BELT | 200 |
| 1 | ASSEMBLY, LIMIT SWITCH 7500# | 222 |
| 1 | BREAKER, CIRCUIT – SYS CONTROL | 142 |
| 1 | ASSEMBLY, BRAKE | 160 |

*Fig. 9*

POWERED BOATLIFT WITH ELECTRONIC CONTROLS

CLAIM OF PRIORITY OF PATENT APPLICATION

This application claims priority to provisionally filed U.S. Patent Application Ser. No. 60/405,283 filed Aug. 22, 2002, which is incorporated herein by reference in its entirety.

BACKGROUND OF THE INVENTION

1. Field of the Invention

This invention relates generally to the field of boatlifts for lifting watercrafts out of the water; and, more particularly to boatlifts that employ controlled power to accomplish the lifting and lowering functions. Still more particularly, the invention relates to a powered boatlift structure that incorporates a unique electronically controlled drive mechanism to effectuate the raising and lowering operation. Further, the invention relates to a boatlift structure having adjustable legs for leveling the structure, while being adapted for ease of mounting a covering canopy.

2. State of the Prior Art

The boating industry is ever-increasing in the number of people participating. The costs of boat ownership and maintenance are also increasing. Pleasure boats and their associated drive engines have tended to become heavier due to incorporation of additional features and accessories on the boats, as well as from additional user amenities, and due to general increases in the size of engines. Such weight increases have caused the prior art manually actuatable boatlifts to become marginal in user acceptability.

It has been recognized that it is desirable to provide lifts that allow boats to be lifted from the water for maintenance, repair, storage, or the like. Pleasure boat users have recognized the desirability of removing boats from the water when not in use, to allow surfaces to dry out and to prevent damage from wave action causing boat-impact with mooring structures. It has also been recognized that it is desirable to provide canopy protection to protect the boat surfaces and interiors from damages due to rain and deterioration from direct sunlight.

Over the years, boatlifts have been developed in various forms and configurations. Many prior art lifts include one or more cables coupled to lift or lower boat support structures. Prior art winch arrangements often involve a number of pulleys and cables, arranged as manually operable winches, to lift boats through application of mechanical force applied via manipulation of manually actuated rotatable drive wheels. Such manually operable winches do not readily accommodate or utilize the same amount of physical exertion for varying weight boats in that the mechanical advantages are usually fixed for each particular target load design. Further, such mechanical winches can be difficult to control when lowering boats into the water, and can cause injuries when inadvertently released.

Other prior art lift structures utilize hydraulic apparatus in various arrangements to lift and position boats. Such structures require availability of hydraulic fluid and availability of substantial power to drive the hydraulic apparatus. Hydraulic structures are relatively more complex and expensive to manufacture, maintain, and operate than other prior art manually operable mechanical winch structures.

Boatlifts are often positioned beside dock structures to provide ease of access. Such lifts are usually supported on legs that have foot structures to engage the support surfaces.

Some leg structures are adjustable in length to accommodate variations in the levels of the supporting ground surfaces upon which the legs rest. Such adjustments allow the lifts to be leveled during installation, but many prior art level adjustment systems do not allow for ease of level selection nor are they readily adjustable after installation.

Some prior art adjustment systems have telescoping members that require pins to be inserted in mating holes in slidably engaged leg members to fix the particular height selections. Such mechanisms are difficult to adjust, and once installed are not readily subject to adjustment. Further, the incremental adjustments often do not allow the boatlift to be substantially leveled. To remedy the leveling problem, prior art lifts have required that shims or other props be utilized under the ground engaging feet to accomplish the final leveling process. These arrangements do not lend themselves to ready adjustment of the leveling of the lift at installation and do not allow ease of level adjustment that may be required as a result of one or more of the ground engaging feet settling.

Other prior art leg adjustment mechanisms involve threaded leg extension mechanisms that are activated from the top extremity of upright support member. Since canopy structures are often mounted to the tops of the upright support members, this form of height adjustment mechanisms makes it difficult or impossible to mount canopy structures on the support legs while maintaining the ability to further adjust leveling of the boatlift.

None of the prior art lift structures are adequate, nor are they designed to provide safety and flexibility in raising and lowering boats through use of a unique powered drive mechanism that allows smooth and linearly controlled raising and lowering with fingertip control. Prior art systems utilized in the pleasure boat industry have primarily been hand operated and have failed to show or utilize electronically controlled power to accomplish the safe raising and lowering functions. Further, the prior art lift structures do not provide convenient leveling mechanisms that allow close control and ease of adjustment of support leg positioning either by hand or with a power tool, while allowing a canopy to be affixed to the boatlift.

SUMMARY OF THE INVENTION

The present invention has been developed to overcome a number of deficiencies in prior art boatlifts, and to provide a boatlift structure that is fabricated from light weight corrosion resistant structural materials, such as aluminum, for members and fittings regularly exposed to water.

An improved boatlift having a plurality of support legs and a moveable boat lifting structure is provided, with the lifting structure moved upwardly and downwardly by a power driven cable assembly. A cable assembly, including a winch cable, is coupled to and is actuated by a reversible electric drive mechanism that is operable in response to operator applied signals for selection of raising or lowering the lifting structure.

It is a purpose of the invention to provide a drive mechanism that is smoothly operable in both the lowering and raising operations. To this end, a ball screw mechanism provides operational performance that allows a ball screw nut to move along the length of a ball screw when the ball screw is rotated in either direction by the reversible electric drive mechanism. With the winch cable attached to the ball screw nut, the winch cable causes the lifting structure to be raised or lowered depending upon the selected direction of rotation of the ball screw.

A mechanical braking system is adapted to hold a suspended load in position once the lifting structure has been raised or lowered to the desired position.

The reversible electric drive mechanism is coupled to the ball screw mechanism. The drive mechanism includes a reversible electric motor with a speed adaptation mechanism, and is controlled by electronic control circuitry. Raising, lowering, or holding the lifting structure at any position is accomplished by application of electrical power to the motor. Application of power will cause the motor shaft to rotate in a selected direction, and removal of power will cause the motor to hold its position. In addition to the mechanical braking system to hold a suspended load in position, electrical dynamic braking is provided to dissipate the momentum of a moving load and reduces wear of the mechanical brake pads.

The electronic control circuitry accomplishes a number of separate but related control functions.

The direction of rotation of the motor shaft is determined by selection of application of power to the motor. The electric motor is reversible and the direction of rotation of the motor shaft is determined by selection of application of input power to the appropriate power terminal. The drive mechanism can be actuated directly by electrical switches for selection of one or the other of the motor power terminals to select the direction of movement. Alternatively, the drive mechanism can also be actuated by wireless remote control signals to accomplish the direction selections. The control circuitry includes conflict detection circuitry to prevent application of concurrent conflicting actuation signals, thereby preventing concurrent application of power to both power terminals of the motor.

Sudden reversal of the drive mechanism causes undue strain on the entire boatlift structure and may cause shifting or damage to the boatlift or the boat being lifted. To avoid this concern, the control circuitry imposes a delay before allowing response to a direction changing control signal, such delay being sufficient to allow the lifting structure to come to a stop before movement in the opposite direction.

Boatlifts can be damaged or can cause injury to a user if the load capacity of the boatlift is greatly exceeded; or if a structural member of the boatlift breaks or becomes stuck; or some external interference prevents normal operation of the boatlift. To minimize the chance of accident or equipment breakage from any of these conditions, the control circuitry includes a load sensing circuit. Since the load current to the motor is in proportion to load weight, the sensing circuit senses the load current, and upon detecting a persistent load current level above a preset value, the sensing circuit disables all lift movement until a manual reset is applied. The stopping of the lift warns the user of excessive stress on the boatlift and allows the user to remedy the condition before activating the reset.

It is often desirable to have electrical power sources for auxiliary lighting or for light power tools. To these ends, the control circuitry controls additional switched power outputs. These outputs can be directly controlled or can be activated by remote wireless activation. To avoid unnecessary power drain, the control circuitry starts a timer when any of the power outputs is activated and automatically turns the power output off upon expiration of the preset time interval.

Another purpose of the invention is to provide an improved boatlift leveling mechanism that can be utilized with selected or all of the support legs of a boatlift. The improved leveling mechanism utilizes a footpad structure for engaging the supporting ground surface, together with a screw mechanism arranged within an associated leg. An adjustment device is arranged on the leg at a convenient height and at a predetermined angle to the screw mechanism. The adjustment device is arranged to cooperate with the screw mechanism to cause the footpad to be extended or retracted depending upon the direction of rotation of the adjustment mechanism. The adjustment mechanism is easily accessible at the predetermined position along the length of the support leg, thereby allowing the upper end of the support leg to be used as a canopy support.

To accomplish the desired purposes the invention includes a powered boatlift having boat lifting means for supporting a boat; a plurality of leveling means for leveling and supporting the boat lifting means; a plurality of leg means for supporting the plurality of leveling means; cable means for raising and lowering the boat lifting means; electric drive means for driving a drive shaft in a first direction in response to a first input signal and for driving the drive shaft in a second direction in response to a second input signal; drive train means coupled to the electric drive means for converting high-speed low-torque input rotation of the drive shaft to low-speed high-torque output rotation; linear driving means coupled to the drive train means for controlling the cable means; and one or more boatlift leveling means coupled to associated ones of the plurality of leg means for leveling the boatlift.

For boatlift leveling purposes the invention includes footpad means for supporting each associated boatlift leg on a surface; a height adjustment means for linearly altering the spacing of the footpad means with respect to the end of an associated boatlift leg, height adjustment actuator means for selectively activating the height adjustment means where the height adjustment actuator means is positioned for accessibility along the length of an associated boatlift leg.

For control purposes the invention includes electronic control of the electric drive means. These controls include input means for receiving a first control signal for raising and a second control signal for lowering a structure, where the first and second control signals are applied directly or from a remote source; lifting logic means for responding to the first and second control signals to actuate lifting or lowering; motor power control means responsive to the lifting logic means for applying power to the electric drive means for raising or lowering a lifting structure. In addition to the basic control of lifting and lowering, the control means includes overload sensing means for sensing overload of the electric drive means and for disabling its operation when overload is sensed; reversal control means for providing a time delay between changes of direction of the lifting structure; level sensing means for sensing the level of the lifting structure and disabling raising and lowering when predetermined levels are sensed; conflict detection means for detecting and resolving conflicting directions to raise and lower the lifting structure; and auxiliary light control means for providing auxiliary lights and for disabling the lights after a predetermined time has elapsed.

These summarized and stated objectives of the invention together with more detailed and specific objectives will become apparent from consideration of the following description of the invention.

BRIEF DESCRIPTION OF THE DRAWINGS

FIG. 9 is a table identifying the components in the reversible electric drive mechanism;

DESCRIPTION OF THE PREFERRED EMBODIMENT

Figure 1:
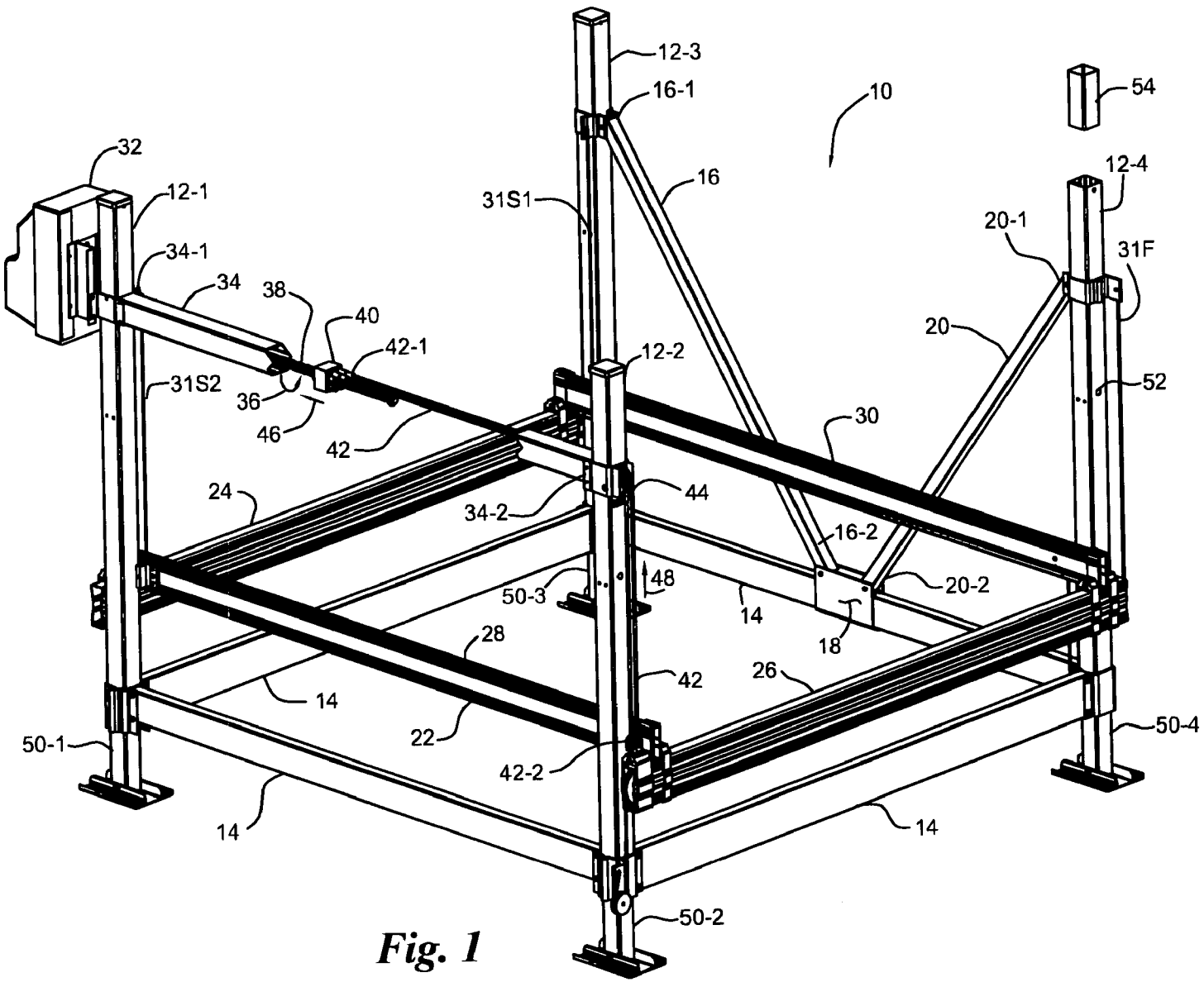
FIG. 1 is perspective view of the boatlift of this invention and illustrates the raising and lowering mechanisms and the boatlift leveling mechanisms.

FIG. 1 is a perspective view of the boatlift of this invention and illustrates the raising and lowering mechanisms and the boatlift leveling mechanisms. Boatlift 10 has four corner posts or legs 12-1, 12-2, 12-3, and 12-4 mounted in the upright positions and held in place by frame beam members 14. To add rigidity and strength to the frame structure, brace member 16 has end 16-1 affixed to an associated leg 12-3 and a second end 16-2 affixed to bracket 18 on frame beam 14, and brace member 20 has end 20-1 affixed to an associated leg 12-4 and a second end 20-2 affixed to bracket 18. A lifting structure 22 has a pair of support members 24 and 26 arranged for supporting a boat (not shown) to be lifted, and a pair of side members 28 and 30.

The lifting structure 22 is maintained level and allowed to move upwardly and downwardly on side leveling cables 31S1 and 31S2 and a front leveling cable 31F. Leveling cables allow single point of lift to be used with lifting structure 22 for holding the lifting structure supported by the legs while being held level. These cables and associated mounting structures will be described in more detail below with reference to FIG. 1A.

A drive mechanism for raising and lowering lifting structure 22 includes a reversible electric drive mechanism within housing 32, with the housing being mounted on leg 12-1. The electric drive mechanism will be described in more detail below. A tubular box beam structure 34 has a first end 34-1 coupled to leg 12-1 that supports housing 32, and is arranged such that the reversible drive (not shown in FIG. 1) is aligned with the interior of the box beam. The second end 34-2 is coupled to leg 12-2, whereby box beam 34 functions to provide structural strength to the boatlift 10, and to enclose ball screw mechanism 36.

A portion of box beam 34 is shown broken away, such that a portion of the ball screw mechanism 36 is exposed. The ball screw mechanism 36 is comprised of elongated ball screw 38 and ball screw assembly nut 40. As will be shown in more detail below, the ball screw 38 has a first end (not shown) coupled to the reversible drive shaft (not shown) of the drive motor (not shown). The ball screw nut assembly 40 includes a round screw nut that is mounted on a plastic block that is substantially in the shape of the interior of the box beam, and is in slidable contact therewith. This assembly will hereafter be referred to as the ball screw nut 40. A winch cable 42 has a portion of its length enclosed within box beam 34, and has a first end 42-1 coupled to the ball screw nut 40. Winch cable 42 extends through an aperture (not shown) in the vicinity of end 34-2, passes over pulley 44, and extends downwardly to a second end 42-2 which is affixed to support member 26.

To raise lifting structure 22 the ball screw 36 is caused to rotate in a direction whereby ball screw nut 40 is moved along the length of the ball screw 36 in the direction of arrow 46, thereby causing winch cable 42 to move in the direction of arrow 48. To lower the lifting structure 22, the action is reversed, and the direction of rotation of ball screw 36 is reversed, thereby causing ball screw nut to move along its length in the opposite direction. The pitch of the threads utilized in the ball screw mechanism 36 is such that the raising and lowering of lifting structure 22 is accomplished smoothly and the elevation can be selected closely within the permissible range of movement of the lifting structure 22.

It is known that boatlifts are often installed along the shores of waterways and that the bottom profiles of the waterways are irregular. It is also known that it is preferable that boatlifts be installed such that the lifts are substantially parallel with the surface of the water upon which boats are floated. To accommodate leveling of the boatlift 10, adjustable footpad structures 50-1, 50-2, 50-3, and 50-4 are shown mounted to legs 12-1, 12-2, 12-3, and 12-4, respectively. It is of course understood that it is not required that a footpad structure be utilized with all of the legs, and that fewer footpad structures can be utilized where the bottom profile warrants a less robust leveling capability.

As will be described in more detail below with reference to FIG. 2, each of the footpad structures is linearly adjustable from a position that is readily accessible. For example, the height adjustment actuator 52 for footpad 50-4 is provided on leg 12-4. The height adjustment actuator 52 comprises a rotatable member having a shaped head that can be manipulated with a mating wrench or other tool, by hand or by a powered mating tool. With the height adjustment actuator 52 positioned along the length of leg 12-4, rather than at the upper extremity of leg 12-4, a canopy support member 53 can be slipped over or otherwise engaged with leg 12-4. This allows a canopy (not shown) to be mounted on each of the legs of boatlift 10, and allows it to be left in place even while leveling the boatlift through manipulation of the various height adjustment actuators.

Figure 1A:
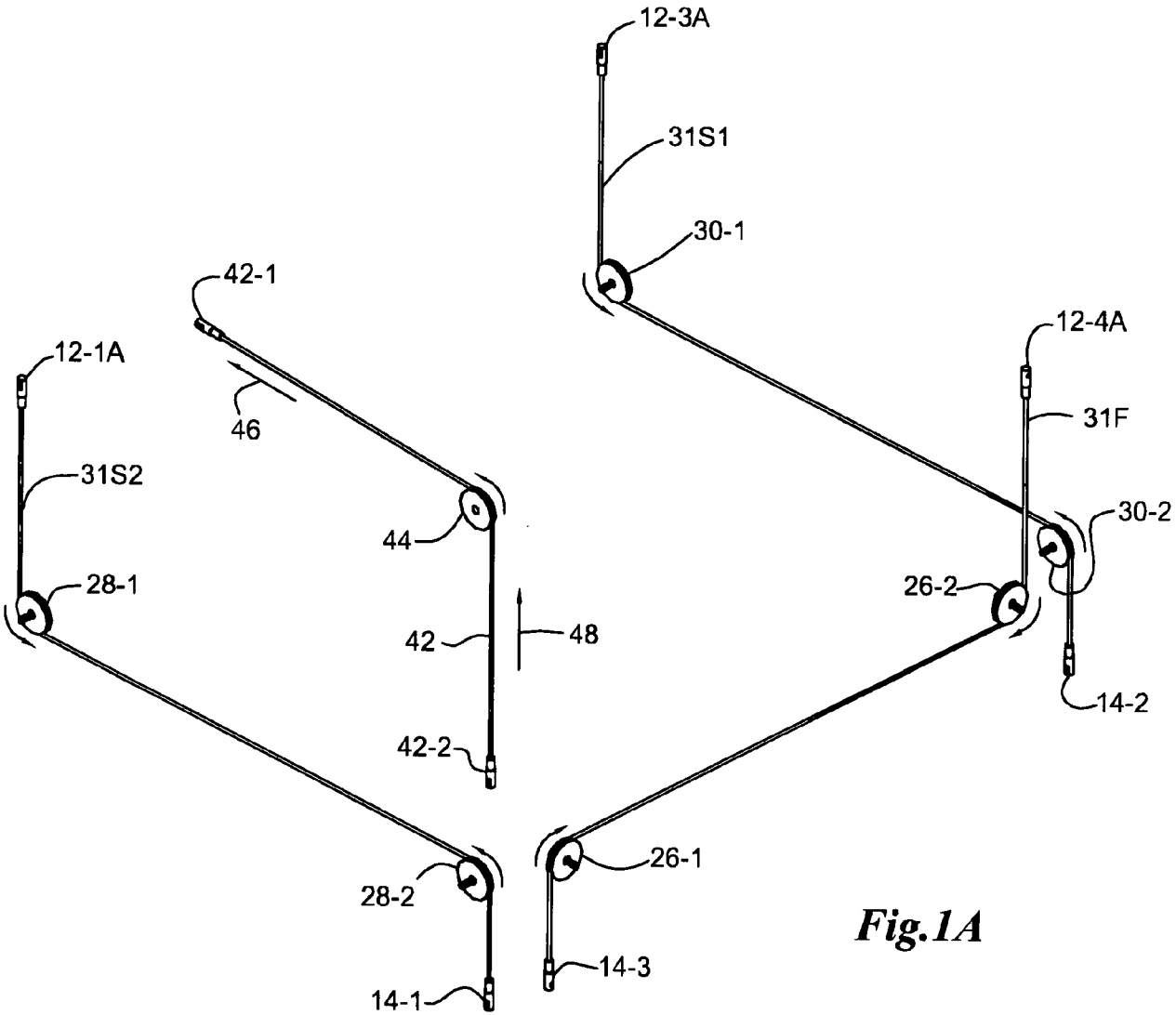
FIG. 1A is a layout diagram of the leveling cables and the winch cable.

FIG. 1A is a layout diagram of the leveling cables and the winch cable. These cables are illustrated disconnected from the leg members, the frame members, and the lifting mechanism. Winch cable 42 is shown engaging pulley 44, which is mounted to leg 12-2. The end 42-1 of winch cable 42 is adapted to connect to the ball screw nut 40, and its end 42-2 couples to lifting structure 22. When the ball screw nut 40 pulls the winch cable in the direction of arrow 46, the lifting structure is raised in the direction of arrow 48.

Side leveling cable 32S2 has end 12-1*a* coupled to leg 12-1 and its end 14-1 coupled to frame 14. The cable 32S2 passes under pulley 28-1 and over pulley 28-2. Pulley 28-1 and pulley 28-2 are rotatably mounted in lifting structure member 28. When the lifting structure 22 is raised, pulley 28-1 and pulley 28-2 rotate counter-clockwise as shown by the arrows. In a similar manner, side leveling cable 31Ss has end 12-3*a* coupled to leg 12-3 and end 14-2 coupled to the frame. The cable 32S1 passes under pulley 30-1 and over pulley 30-2. Pulley 30-1 and pulley 30-2 are rotatably mounted in lifting structure member 30. When the lifting structure 22 is raised, pulley 30-1 and pulley 30-2 are rotated counter-clockwise.

The front lifting cable 31F has its end 12-4*a* coupled to leg 12-4 and its end 14-3 coupled to frame 14. Cable 31F passes over pulley 26-1 and under pulley 26-2 and both pulley 26-1 and pulley 26-2 are rotatably mounted to lifting structure member 26. When the lifting structure is raised, both pulleys 26-1 and 26-2 are rotated in a clockwise manner.

The leveling cable arrangement holds the lifting structure 22 in a substantially level condition, while lifting force is applied at a single point on the lifting structure. Leveling cable arrangements of various configurations have been know, but the arrangement described has been found to provide superior performance while allowing the lifting structure to be lowered to allow the lifting structure 22 to rest on frame members 14 at the lowest level of the lifting structure.

Figure 2:
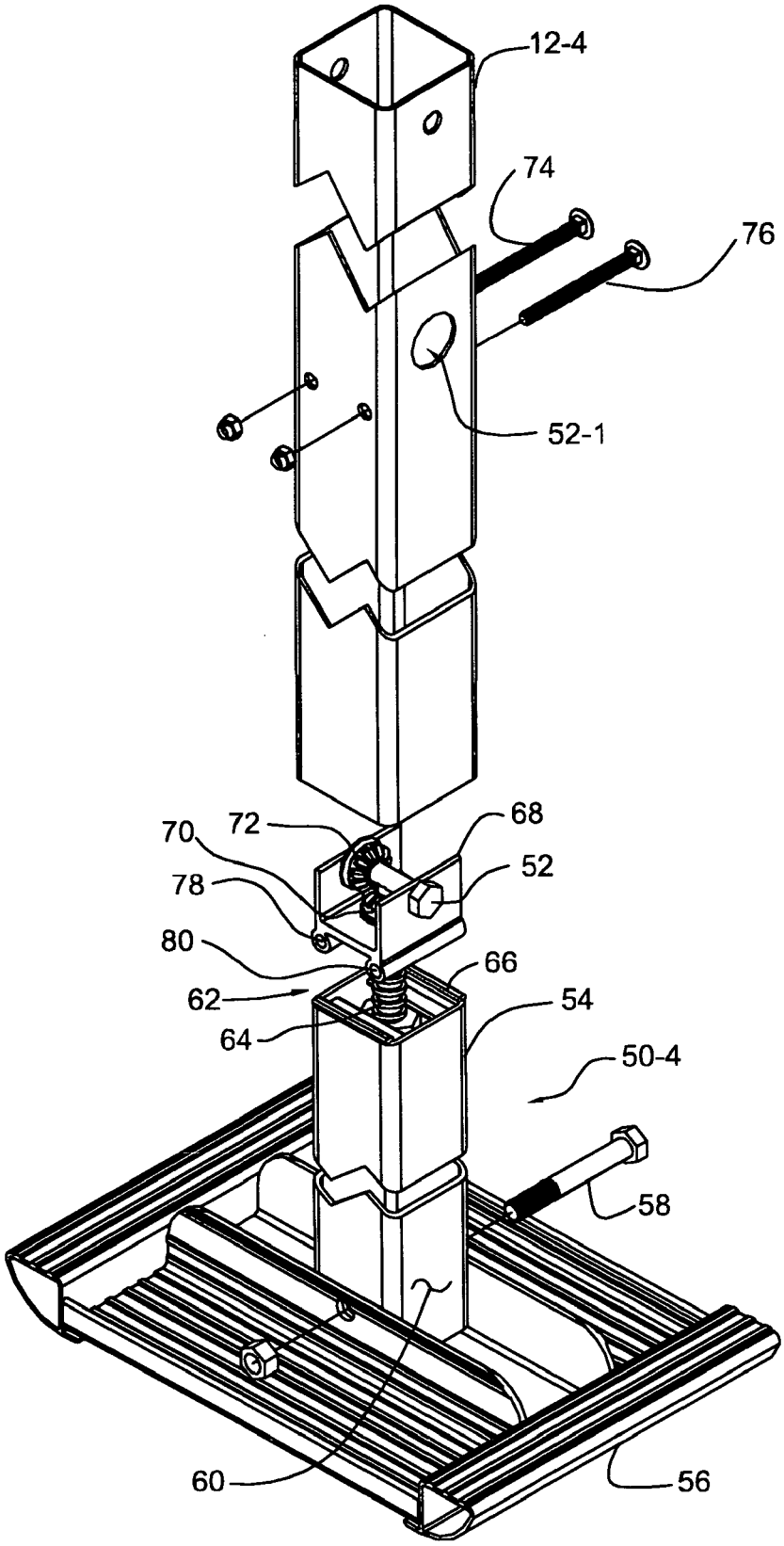
FIG. 2 is a perspective view of the boatlift leveling mechanism, with a portion cut away.

FIG. 2 is a perspective view of the boatlift leveling mechanism, with a portion cut away. The adjustable footpad structure 50-4 includes an inner leg 54 that is formed generally in a predetermined tubular cross-section, which for one embodiment is substantially square. It is of course understood that the cross-section could equally as well be rectangular, round, or whatever form is deemed desirable for a particular construction. The leg 12-4 also has a predetermined tubular cross-section; and, for the preferred embodiment, the cross-section is substantially square with a longitudinal tubular opening having a predetermined inside shape. The outer surface of the inner leg 54 is adapted to approximately match and to be slidably received within the predetermined inside shape of leg 12-4. A footpad 56 is moveably coupled via bolt 58 to the lower end 60 of inner leg 54.

A height adjusting screw mechanism 62 is positioned within inner leg 54. A nut 64 is mounted to the inside of inner leg 54. The inner leg 54 is moved upwardly or downwardly depending upon the direction of rotation of elongated screw 66, which can be an Acme screw.

The upper end of screw 66 passes through an aperture in bracket 68 and has affixed bevel gear 70 mounted at its upper extremity. Height adjustment actuator 52 has a shaped head and a shaft that extends through an aperture in bracket 68, and has a mating bevel gear 72 mounted thereon. Affixed bevel gear 70 mates with bevel gear 72.

The assembly is shown cut away and partially exploded, it being understood that when assembled, bracket 68 will be mounted to leg 12-4 by bolts 74 and 76 passing through bracket structural openings 78 and 80, respectively. When in place, the shaft of height adjustment actuator 52 extends through aperture 52-1 and is accessible along leg 12-4. The exposed head of the height adjustment actuator 52 is of a shape that can be engaged by a suitable wrench, or other driving tool, to cause rotation. In the preferred embodiment head of actuator 52 is a bolt head, but it is understood that the shape of the head could be in any configuration that would engage any other mating type of driving tool. Rotation of the height adjustment actuator 52 in a first direction causes the mating bevel gears 70 and 72 to rotate the screw 66 in a manner to move leg 54 downwardly. Rotation of the height adjustment actuator 68 in the opposite direction causes the mating bevel gears to rotate the screw 66 in a manner to move leg 54 upwardly. The screw mechanism 62 allows close linear control of the height adjustment for the associated leg of a boatlift and obviates many of the deficiencies in prior art height adjustment structures.

Though the preferred embodiment utilizes inner leg 54, which is slidably received within the predetermined inside shape of leg 12-4, it should be understood that this relationship could be reversed such that leg 54 slidably engages the outer surface of leg 12-4, without departing from invention.

Figure 2A:
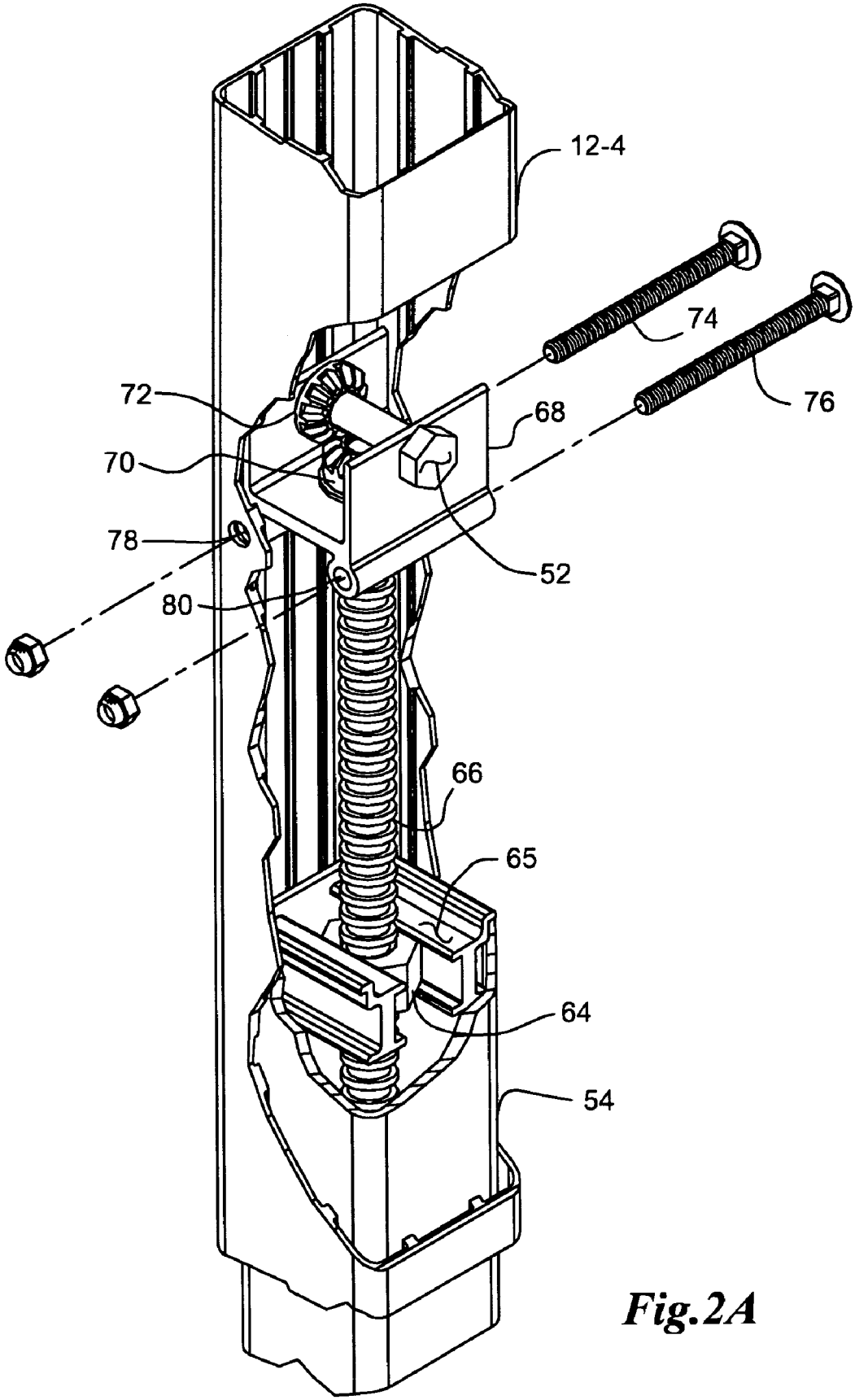
FIG. 2A is a cutaway perspective view of the level adjustment portion of the boatlift leveling mechanism shown in FIG. 2.

FIG. 2A is a cutaway perspective view of the of the level adjustment portion of the boatlift leveling mechanism shown in FIG. 2 and described above. It more clearly illustrates how ball nut 64 is retained within the mounting structure 65 in a manner that prevents ball nut 64 from moving with respect to leg 54. It further illustrates how mounting structure 65 fits closely within the tubular opening of leg 54. The beam-like cross-section of mounting structure 65 provides sufficient strength to support the corner weight of the boatlift as the ball nut 64 is moved up or down along ball screw 66.

As described above, bracket 68 is affixed within leg 12-4 by bolts 74 and 76. Bracket 68 also holds bevel gear 70 in a mating relationship with bevel gear 72, such that when height adjustment actuator 52 is turned, bevel gear 72 will cause bevel gear 70 to impart similar rotation to ball screw 66. When thus rotated, ball screw 66 will cause ball screw nut 64 to extend inner leg 54 or to pull inner leg 54 within leg 12-4. In the preferred embodiment mating bevel gears 70 and 72 position height adjustment actuator 52 substantially perpendicular to the longitudinal axis of ball screw 66, thereby allowing the height adjustment from the side of leg 12-4. Further, the ratio of the number of teeth on bevel gear 72 to the number of teeth on bevel gear 70 determine the mechanical advantage, if any, and will determine the number of revolutions of actuator 52 that will be required for each revolution of ball screw 66.

Figure 3:
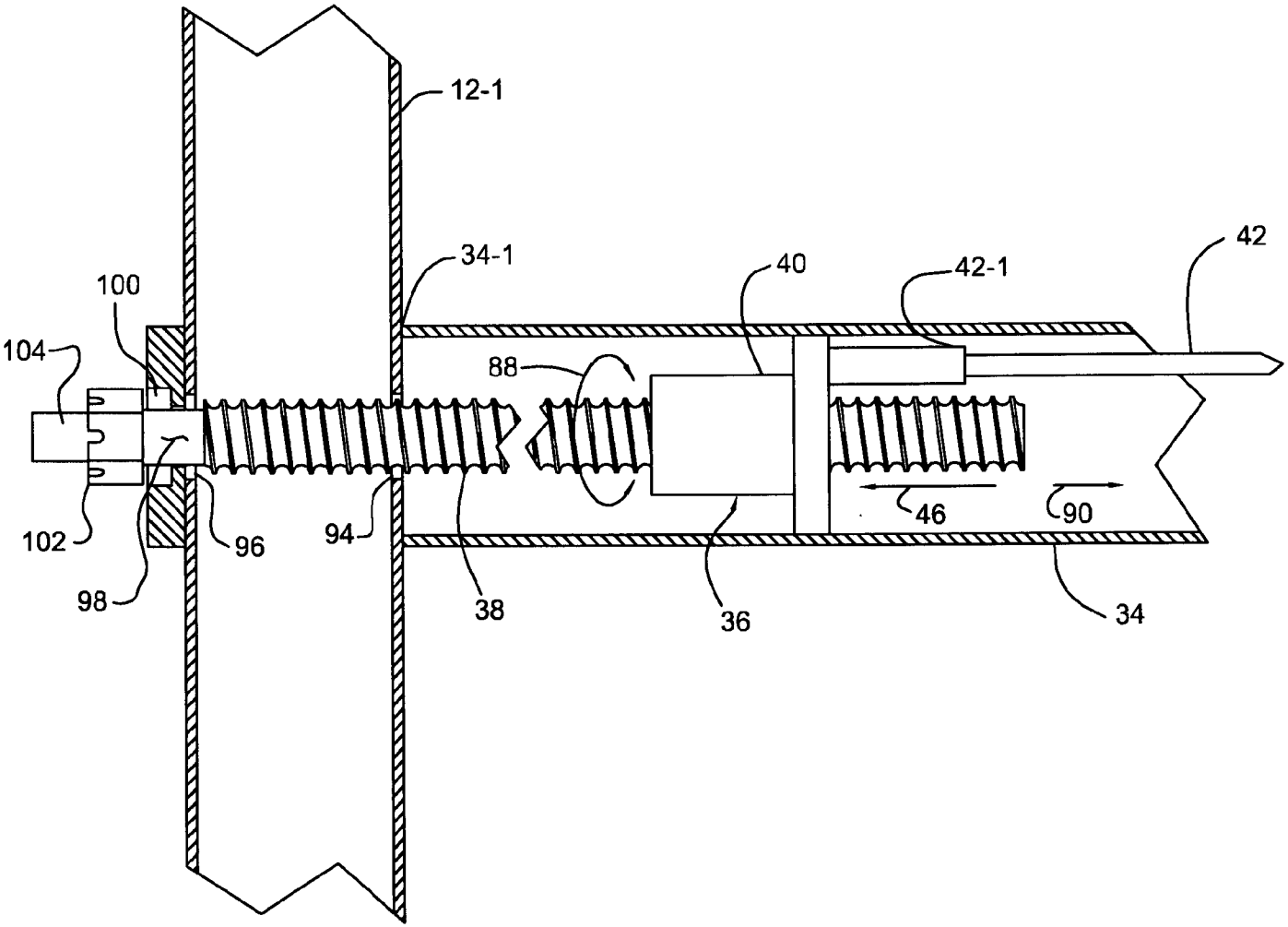
FIG. 3 is a partial cutaway view of the ball screw mechanism utilized for raising and lowering loads.

FIG. 3 is a partial cutaway view of the ball screw mechanism utilized for raising and lowering loads. Box beam 34 encloses ball screw mechanism 36 and is mounted to leg 12-1 at juncture 34-1. The ball screw mechanism includes elongated ball screw 38 with ball screw nut 40 associated therewith including a round screw nut and its associated plastic block as described above. The plastic block portion of ball screw nut 40 is slidably engaged within box beam 34 and is affixed to end 42-1 of winch cable 42. Ball screw 38 is threaded and is threadedly engaged with ball screw nut 40 for causing ball screw nut 40 to move along its length in either direction, such movement dependant upon the direction of rotation of ball screw 38. Ball screw 38 is rotatable in either direction, as indicated by arrow 88. Ball screw nut 40 is moved in the direction of arrow 46 when ball screw 38 is rotated in a direction to raise the lifting structure 22. Ball screw nut 40 is moved along the length of ball screw 38 in the direction of arrow 90 when ball screw 38 is rotated in a direction to lower the lifting structure 22. Ball screw 38 passes through apertures 94 and 96 in the walls of leg 12-1 and has a non-threaded portion 98 supported by thrust bearing 100 and held in place by slotted nut 102. Exposed end 104 and slotted nut 102 are engaged by drive elements within housing 32, as will be described in more detail below.

Figure 4:
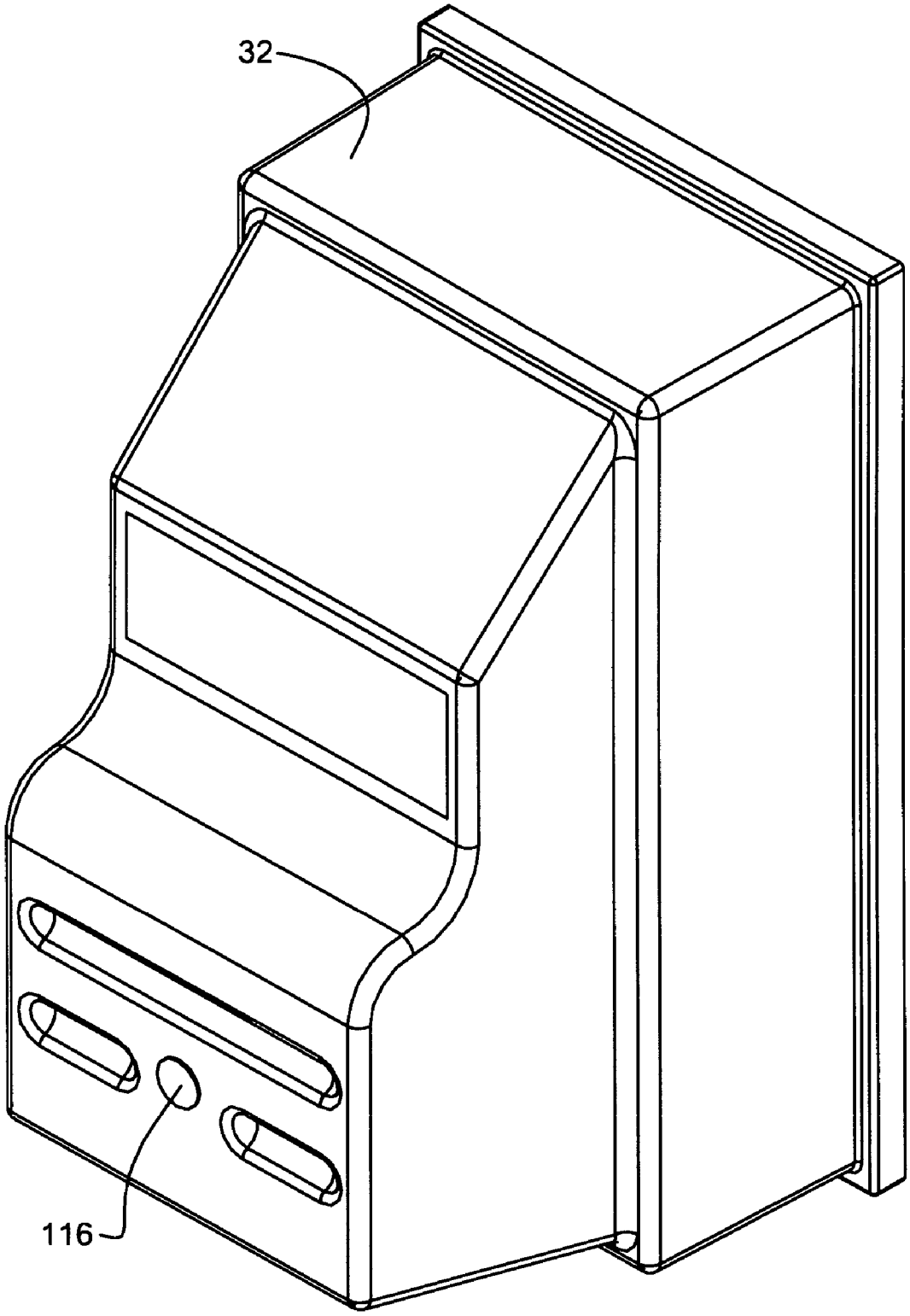
FIG. 4 is a perspective view illustrating the cover for the reversible electric drive mechanism cover.

FIG. 4 is a perspective view illustrating the cover for reversible electric drive mechanism. Cover 32 is of a predetermined shape to encase the reversible electric motor and the brake mechanism, as will be described below. Aperture 116 allows access to the shaped rear end of the motor drive shaft. The shape of the rear end will be selected to accommodate a matching socket (not shown), which illustratively can be a hexagonal shape, and allows movement of the lift using an external drive mechanism (not shown).

Figure 5:
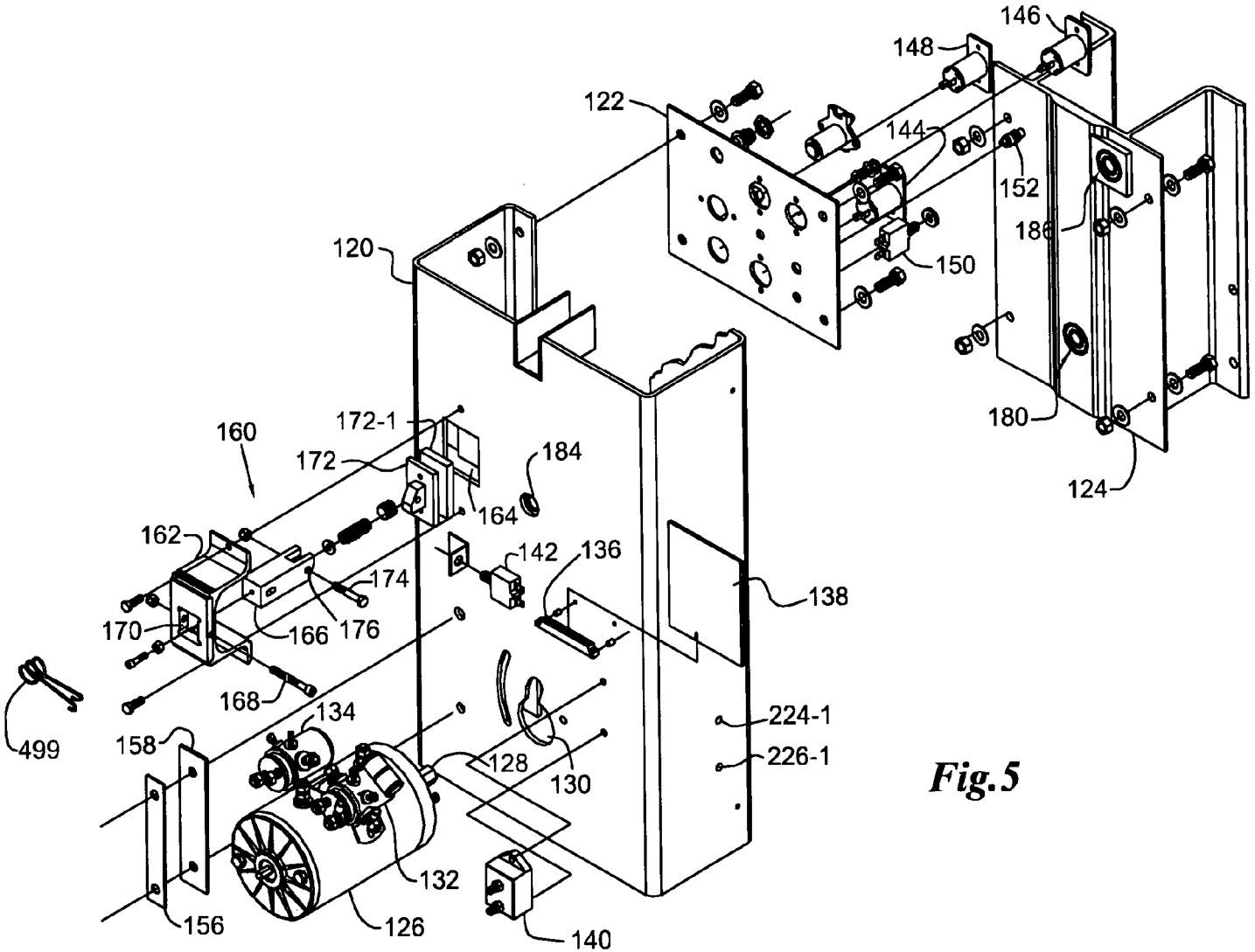
FIG. 5 is an exploded perspective view illustrating the relationship of the drive motor and the braking structure to the drive train mechanism gear box as they all relate to the mounting structure for the reversible electric drive mechanism.

FIG. 5 is an exploded perspective view illustrating the relationship of the drive mechanism gear box to the mounting structure for the reversible electric drive mechanism. The drive mechanism gear box 120 is coupled to plate 122, and mounting bracket 124 mounts the entire assembly to an associated leg 12-1. An electric motor 126 has a rotatable drive shaft 128 that extends through aperture 130. The drive shaft 128 is keyed for driving a pulley (not shown in FIG. 5). Solenoid 132 is coupled to motor 126 and operates to cause motor 126 to turn its drive shaft 128 in a first direction when a first electric signal is applied to activate solenoid 132. In a similar manner solenoid 134 is coupled to different terminal on motor 126 and operates to cause motor 126 to turn it drive shaft 128 in a second direction when a second electric signal is applied to activate solenoid 134.

A printed circuit board connector 136 is mounted on gear box 120, and adapted to mount and electrically connect printed circuit board 138 to the electrical circuitry, as will be described in more detail below. For the preferred embodiment connector 136 is a commercially available edge-connector. The printed circuit board 138 embodies the novel drive selection and control circuits, as will be described in more detail below.

Thermal circuit breaker 140 and system control circuit breaker 142 are mounted to the face of gear box 120, and will be functionally described below.

Plate 122 mounts power sockets 144, 146, and 148, which for this embodiment 12 volt cigarette lighter type sockets. It also mounts lighting circuit breaker 150 and motor reset switch 152. These sockets, the circuit breaker and the limit switch are commercially available components. The physical attachment of plate 122 to gear box 120 is by nuts and bolts.

A resistor 156 is mounted on insulator 158 to the face of gear box 120. The function of resistor 156 is as a current sensing resistor and will be described in more detail below.

A brake mechanism 160 is comprised of mounting bracket 162, which is mounted in an operative relationship to aperture 164. Brake actuator 166 is rotatably mounted by pin 168 within aperture 170. Brake pad 172 mount is rotatably mounted by pin 174 to actuator 166. Actuator 166 has a beveled portion 176 that allows the brake pad to 172-1 disengage when a load is being lifted and allows the brake pad 172-1 to come in contact and engage when the upward movement of a load stops. This causes the brake 160 to hold the load in place when not being moved by action of motor 126. The brake remains engaged during the downward movement, and restrains the rate of descent.

Bracket 124 has a first aperture 180 in a position to cooperate with exposed end 104 of elongated ball screw 38 and is in cooperative alignment with aperture 184 in gear box 120. A second aperture 186 in bracket 124 is in a position to cooperate with an axle in a drive train assembly that will be described below. Bracket 124 is mounted to drive mechanism gear box 120 by a plurality of bolts or equivalent fastening structures.

Figure 6:
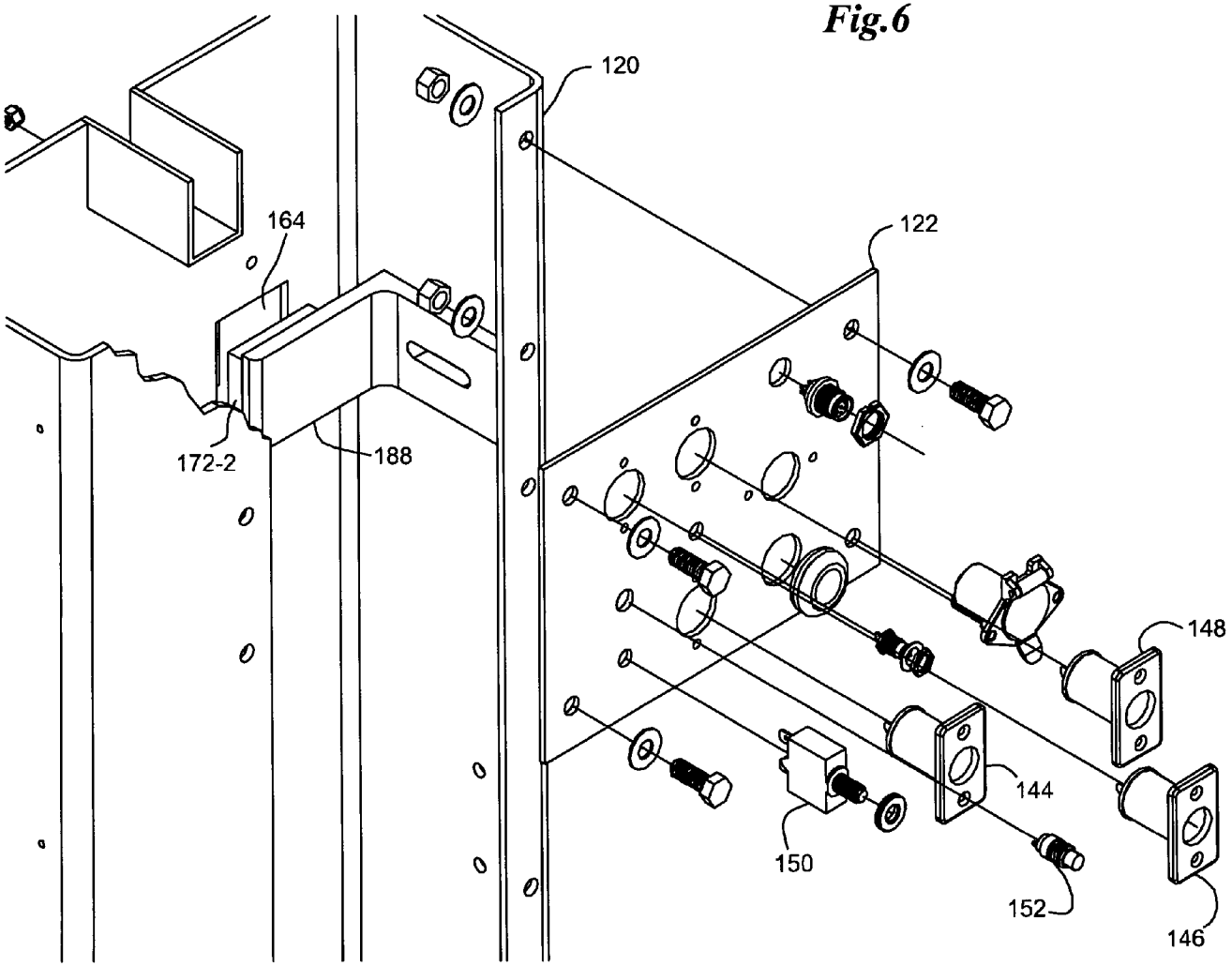
FIG. 6 is a reversed exploded view of the mounting plate and mounted components shown in FIG. 5.

FIG. 6 is a reversed exploded view of the mounting plate and mounted components shown in FIG. 5. Power sockets 144, 146 and 148 are mounted in associated apertures in plate 122. Lighting circuit breaker 150 and motor reset switch 152 are also mounted in associated apertures in plate 122.

Mounting bracket 188 is mounted to a back member of gear box 120. A brake pad 172-2 is affixed to bracket 188 and is positioned in a position to cooperate with brake mechanism 160.

Figure 7:
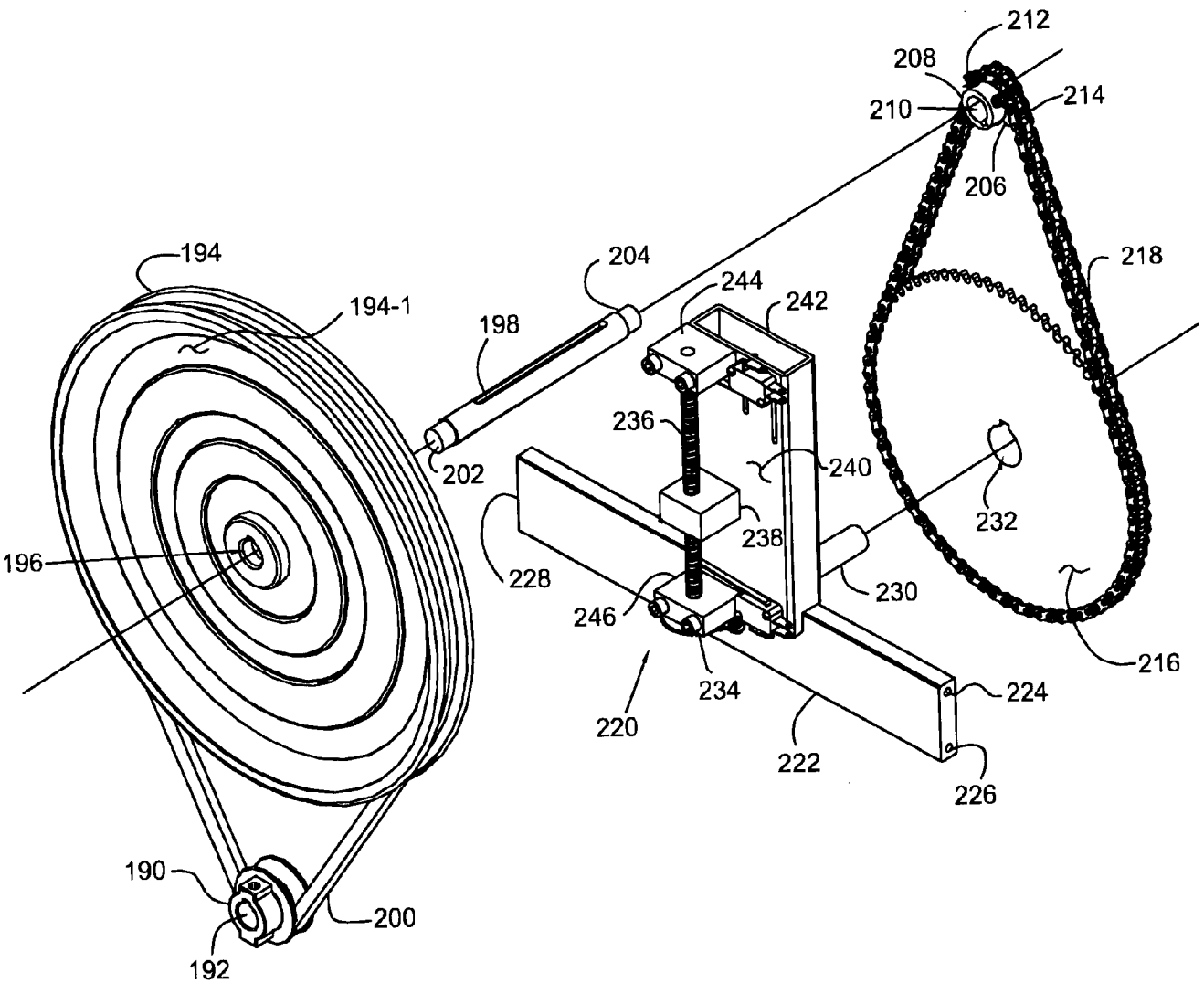
FIG. 7 is an exploded view of the torque converting assembly and the lift limit structure for the reversible drive mechanism.

FIG. 7 is an exploded view of the drive train assembly for the reversible drive mechanism. The drive train assembly includes a pulley 190 having a keyed drive aperture 192 arranged for access at aperture 130 in gear box 120, such that keyed drive aperture is mounted on keyed drive shaft 128 of motor 126. Pulley 190 has a first predetermined diameter. A second pulley 194 has a second predetermined diameter greater than the diameter of pulley 190. Pulley 194 has a keyed aperture 196 to receive and be driven by axle 198. Pulley 190 is coupled to pulley 194 by a v-belt 200. A first end 202 of axle 198 is adapted to cooperate with and be supported in aperture 184 of gear box 120 and a second end 204 is adapted to cooperate with and be supported in aperture 186 in bracket 124.

The braking and holding operation is accomplished by brake 160 applying braking pressure to opposite sides of pulley 194. Pad 172 impinges on face area 194-1 and brake pad 172-1 impinges on the opposite face of pulley 194. The pulley and drive belt structure allows a safety factor in that the pulley can slip for a short time, if necessary, to allow power to be removed in the event something causes the lift to exceed its capacity or the lift becomes jammed or broken, thereby protecting the motor from burn out.

The drive train assembly also has gear 206 with coupling 208 arranged to receive axle 198 through aperture 210. Coupling 208 includes set screws 212 and 214 to apply pressure to axle 198 to thereby hold gear 206 in place on the axle. Gear 206 is also referred to as a sprocket and has a third predetermined diameter. A second gear (sprocket) 216 is coupled to gear 206 by chain drive 218. Gear 216 has a fourth predetermined diameter larger than the third predetermined diameter of gear 206.

A limiting structure 220 provides power shut off to motor 126 when the winch cable 42 has been moved to a predetermined elevated lift position or to a predetermined lowered position. A mounting bar 222 has mounting holes 224 and 226, and is arranged to be mounted in gear box 120 at mating apertures 224-1 and 226-1, respectively, with similar mounting holes (not shown) at end 228.

A drive shaft 230 cooperates with aperture 232 in gear 216 and aperture 180 in bracket 124. Drive shaft 230 is mounted to drive gear 234. Gear 234 is mounted to screw 236, which in turn causes an associated screw nut 238 to be moved along the length of screw 236 depending upon its direction of rotation. Nut 238 cooperates with face 240 of member 242 to position ball 238 as it moves along screw 236.

When nut 238 moves to its upper extremity of movement, it activates limit switch 244. Limit switch 244 functions to disconnect electrical power from the drive motor 126 as will be described in more detail below. Similarly, when nut 238 is moved to its lower extremity of movement, it activates limit switch 246 to disconnect electrical power from the drive motor 126.

The ratio of the first predetermined diameter of pulley 190 to the second predetermined diameter of pulley 194 provides a proportional reduction in the rate of rotation of shaft 198 with respect to the rate of rotation of drive shaft 128. This relationship also provides a corresponding mechanical advantage resulting in increased torque at shaft 198. The ratio of the third predetermined diameter of gear 206 to the fourth predetermined diameter of gear 216 provides a proportional reduction in the rate of shaft 230 with respect to the rate of rotation of shaft 198. This relationship provides further corresponding mechanical advantage resulting in increased torque at shaft 230.

It can be seen, then, that the drive train assembly functions to convert high-speed low-torque rotation of drive shaft 128 to low-speed high-torque rotation of shaft 230, thereby allowing electric motor 126 to provide sufficient torque to drive ball screw assembly 36 at rates acceptable for raising and lowering boats. These ratios will be determined as necessary to accomplish desired load lifting capacities and rates of raising and lowering, when considered for a particular drive motor.

Figure 7A:
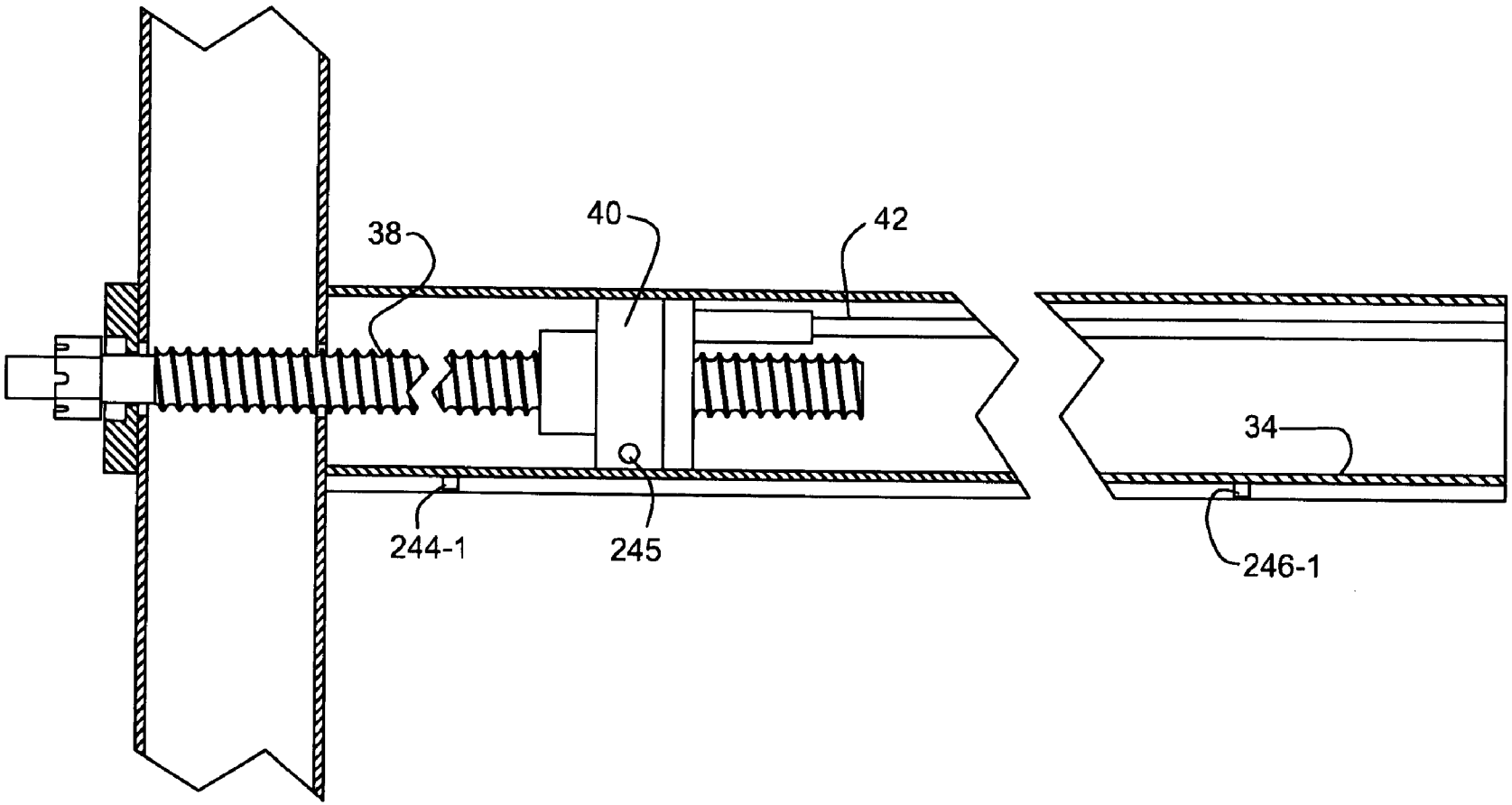
FIG. 7A is an alternate lift limit sensing structure incorporated in the ball screw mechanism.

FIG. 7A is an alternative lift limit sensing structure incorporated in the ball screw mechanism. In this arrangement the assembly of gear 234, ball screw 236, ball screw nut 238, and limit switches 244 and 246 are not used. Instead, magnetic switches 244-1 and 246-1 are mounted in member 34 at predetermined positions indicative of the upper and lower travel limits of winch cable 42, respectively. A magnet 245 is mounted to ball screw nut 40. When ball screw 38 moves ball screw nut 40 to a position such that magnet 245 activates magnetic switch 244-1, it indicates the upper lift position has been reached and the power will be removed from the lifting circuit. In a lo similar manner, when ball screw nut 40 is moved to a position such that magnet 245 activates magnetic switch 246-1, it indicates the lower lift position has been reached and power is removed.

Figure 8:
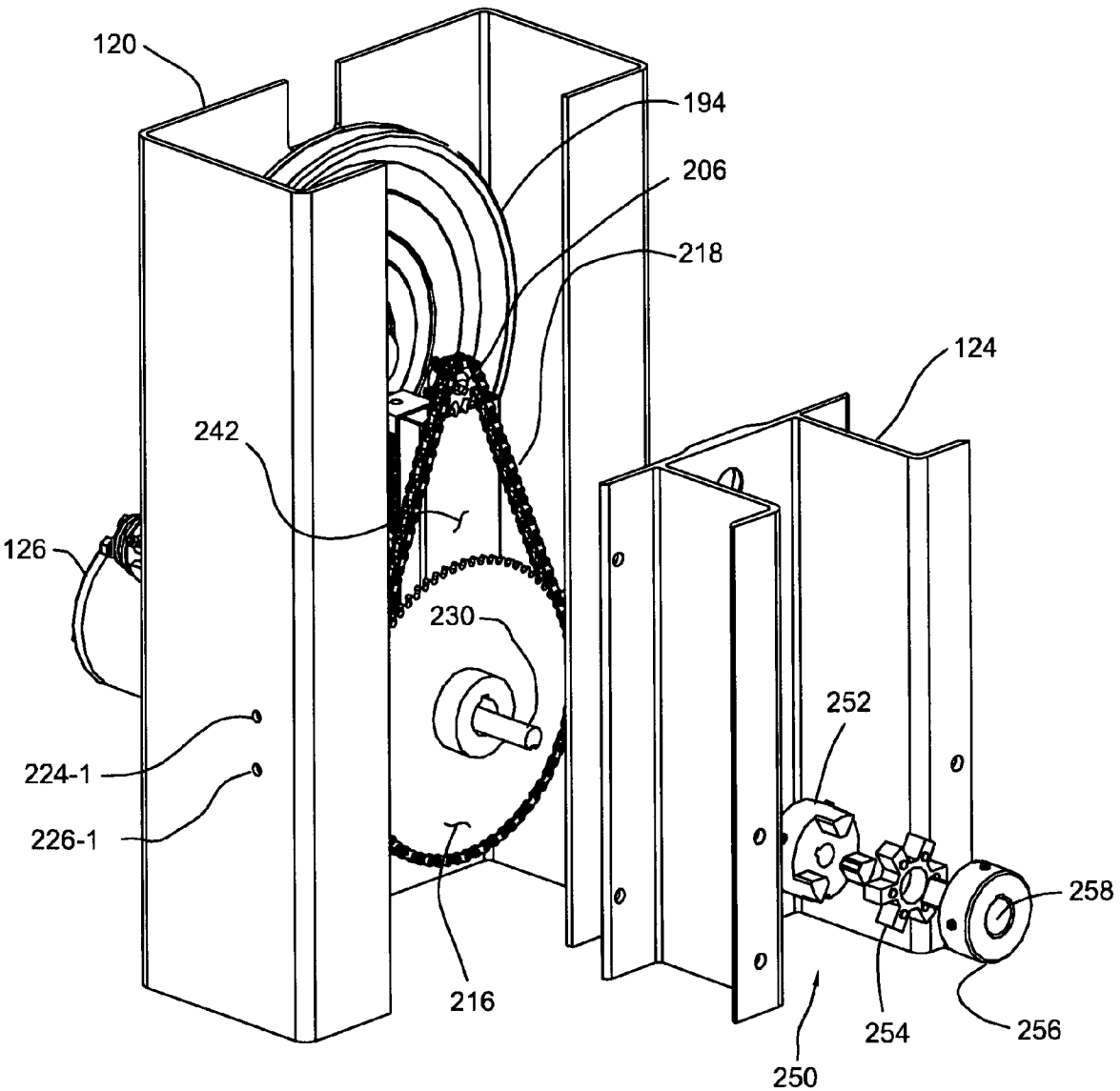
FIG. 8 is a perspective view of the drive train assembly shown in FIG. 7.

FIG. 8 is a perspective view of the drive train assembly shown in FIG. 7. Pulley 194 is mounted within gear box 120 with end 204 of shaft 198 positioned to cooperate with aperture 186 in bracket 124. Gear 216 is mounted on shaft 230, which in turn is positioned to cooperate with aperture 180 in bracket 124. Bracket 124 is positioned to be affixed to and to support the gear box 124. When assembled, the end of shaft 230 is coupled to a Lovejoy coupler 250. Shaft 230 is affixed to drive member 252 that interacts with engagement member 254. Mounting member 256 is arranged to be affixed to the driving end 104 of elongated ball screw 38.

While the pulley and gear assembly has been found to be particularly well suited for use in the invention, it is understood that other equivalent structures could also be used, without departing from the inventive concepts. Such structures could include hydraulic drives, gear trains, or other suitable structures.

FIG. 9 is a table identifying the components in the reversible electric drive mechanism. The identified components are commercially available, and are identified for use in the preferred embodiment of the invention.

Figure 10:
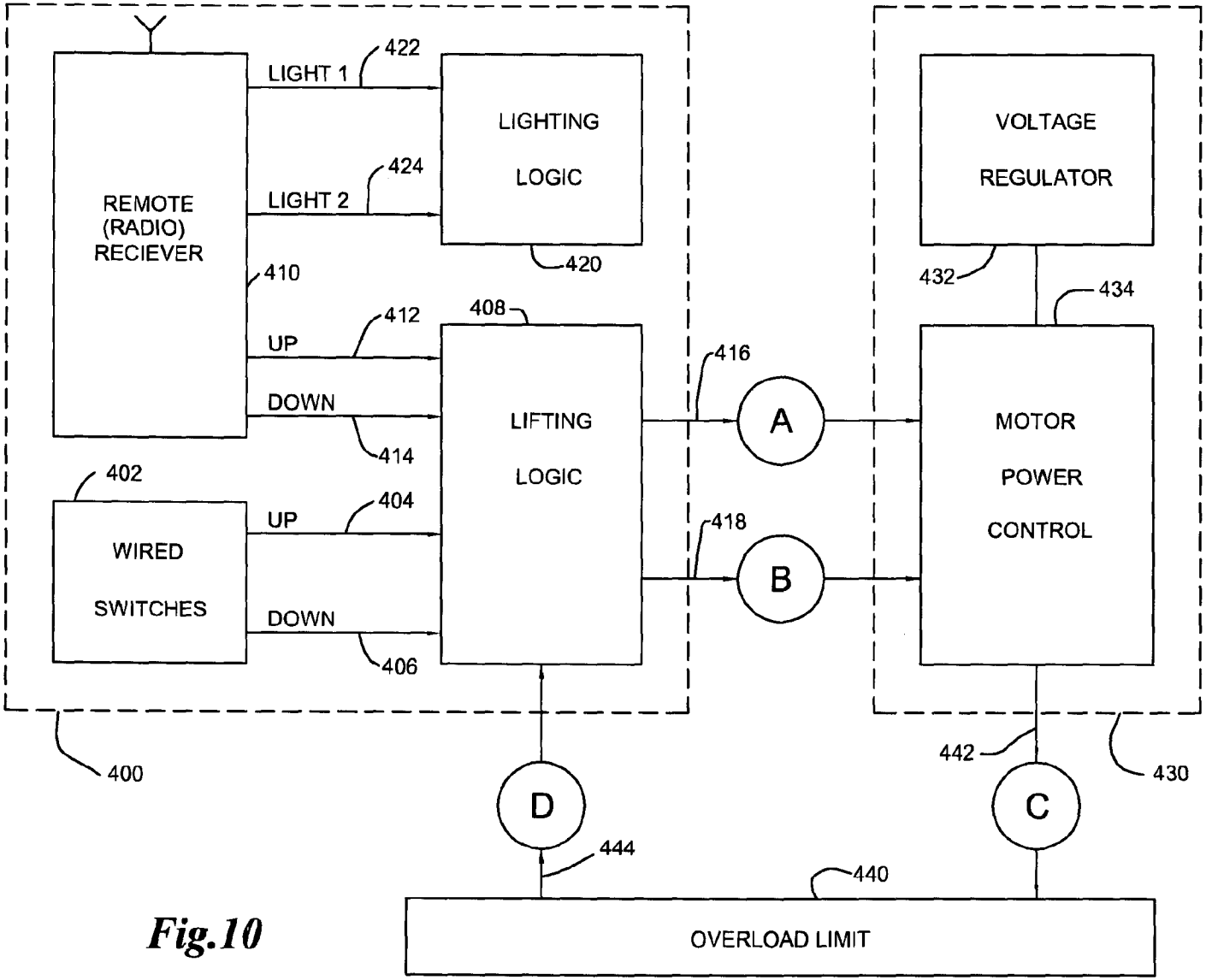
FIG. 10 is a schematic block drawing of the electrical control and power circuits utilized in the invention.

FIG. 10 is a schematic block drawing of the electrical control and power circuits utilized in the invention. Shown within dashed block 400 are the Wired Switch means 402 for providing first predetermined signals on line 404 to actuate the 'Up' movement of the lift and for providing second predetermined signals on line 406 to control the 'Down' movement of the lift via the Lifting Logic 408. Alternative lift control is provided through the Remote Receiver 410. The Remote Receiver 410 functions to receive wireless control signals from an associated transmitter (not shown), and in response to received signals includes means for providing a signal on line 412 to actuate the 'Up' movement of the lift and means for providing a signal on line 414 to actuate the 'Down' movement of the lift.

The Lifting Logic 408 includes means responsive to the alternative 'Up' signals received on lines 404 and 412 to provide a first enabling signal on line 416 for enabling the lifting action of the lift. This is accomplished as an activation signal to relay 132. Alternatively, Lifting Logic 408 includes means responsive to the alternative 'Down' signals received on lines 406 and 414 to provide a second enabling signal on line 418 for enabling the lowering action of the lift. This is accomplished as an activation signal to relay 134.

The Remote Receiver 410 also functions to receive wireless control signals for activation or deactivation of the Lighting Logic 420 that controls the auxiliary lights. Signals to control Light 1 are provided to the line 422 and signals to control Light 2 are provided on line 424. While this embodiment utilizes two auxiliary lights, it is of course understood that fewer or more lights can be controlled without departing from the inventive concepts.

Shown within dashed block 430 are the Voltage Regulator 432 and the Motor Power Control 434 that is controlled by the signals received on lines 416 and 418 from the Lifting Logic 408. The Motor Power Control 434 includes the power source for driving the lift, which in this case is a dc source of electrical current, as will be described in more detail below. The Motor Power Control 434 includes solenoids 132 and 134 for activating the direction of rotation of the motor 126. It further includes limit detecting means for determining when the lift has moved to a first predetermined maximum raised level and to a second predetermined lowered level; and, in both cases includes means for deactivating further raising or lowering, respectively. Additionally, the Motor Power Control 434 includes means for providing dynamic braking through the back emf of the motor when power is removed.

The Voltage Regulator 432 utilizes the power from the battery to provide the required regulated voltages needed to power the electronic circuitry. As an alternative, 110 volt ac power could be utilized with requisite rectification and reduction to the dc levels utilized to power and regulate the electronic circuitry. Such alternative power sources are known and will not be described further.

The Overload Limit 440 circuitry is coupled via line 442 to the power source in Motor Power Control 434, and functions to determine when the electrical current applied to the motor has exceeded a predetermined threshold. The motor current has a relationship to the weight of the load being lifted, and operates as a predictor that the capacity of the lift is in danger of being exceeded. This can occur from attempting lift a load that is too heavy for the lift, or from the lift mechanism being jammed or broken. To protect the lift from damage or destruction and to protect the operator, a sensed overcurrent condition results in the Overload Limit circuitry issuing a disable signal on line 444 to the Lifting Logic 408. The disable signal causes the Lifting Logic 408 to remove the enabling signal from the enabled one of lines 416 or 418, thereby removing power from the electric motor and causing lifting to cease.

The symbols A, B, C, and D indicate the interconnection points in the schematic block diagrams that illustrate the circuits that accomplish the functions described.

Figure 11A:
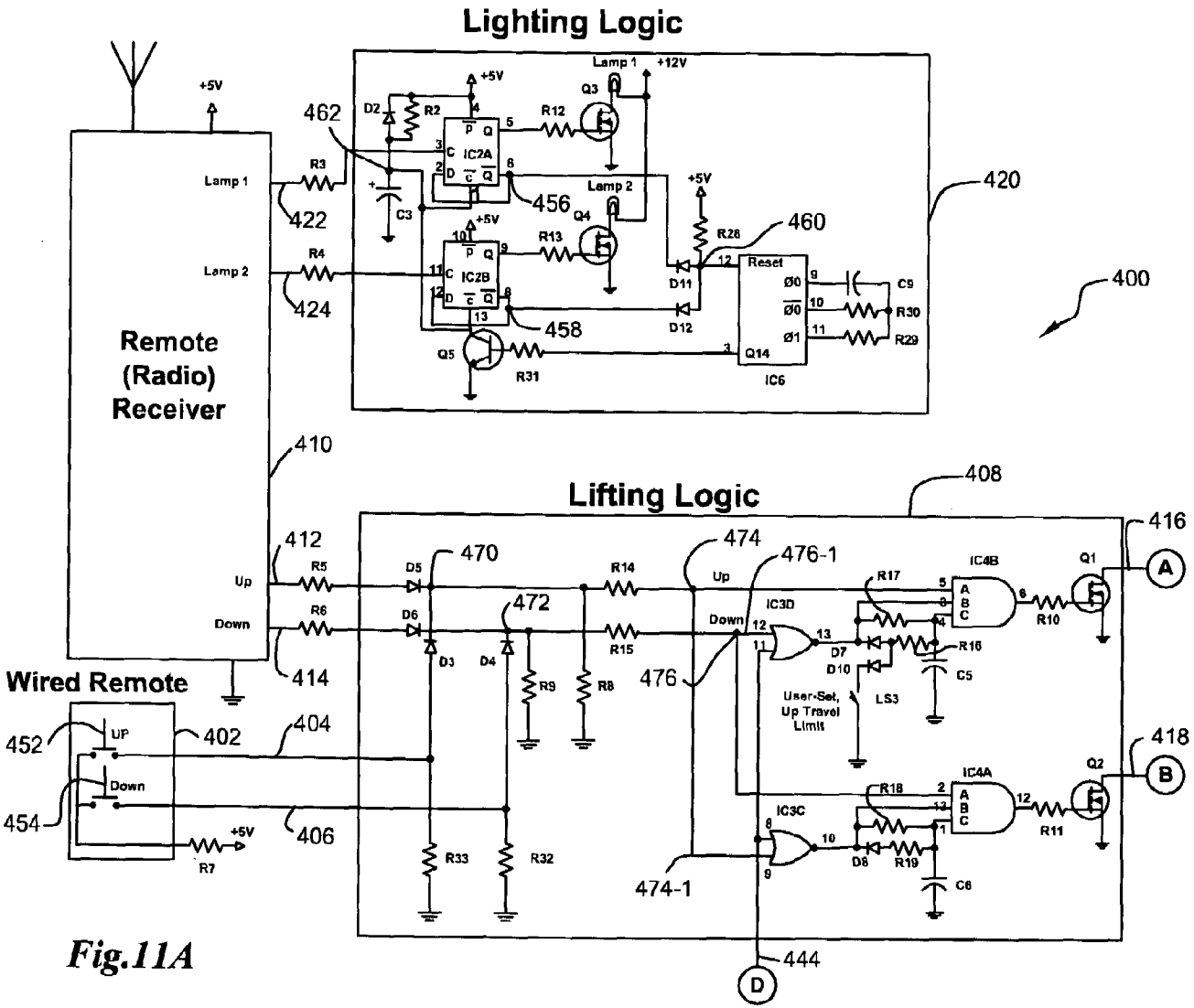
FIG. 11A is a schematic block diagram of the electronic control circuitry that controls operation of the auxiliary lighting and the Lifting Logic for the reversible electric drive mechanism.

FIG. 11A is a schematic block diagram of the electronic control circuitry that controls operation of the auxiliary lighting and the Lifting Logic for the reversible drive mechanism.

Figure 11B:
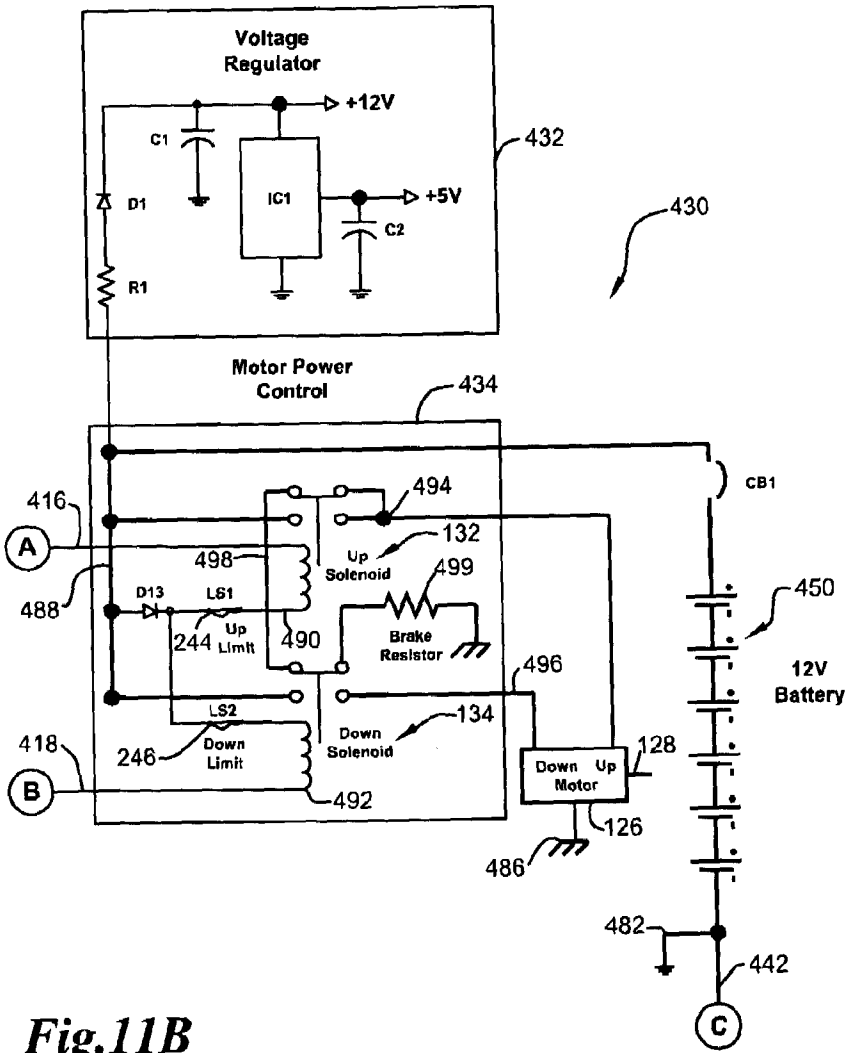
FIG. 11B is a schematic block diagram of the Voltage Regulator and the Motor Power Control.

FIG. 11B is a schematic block diagram of the Voltage Regulator and the Motor Power Control.

Figure 11C:
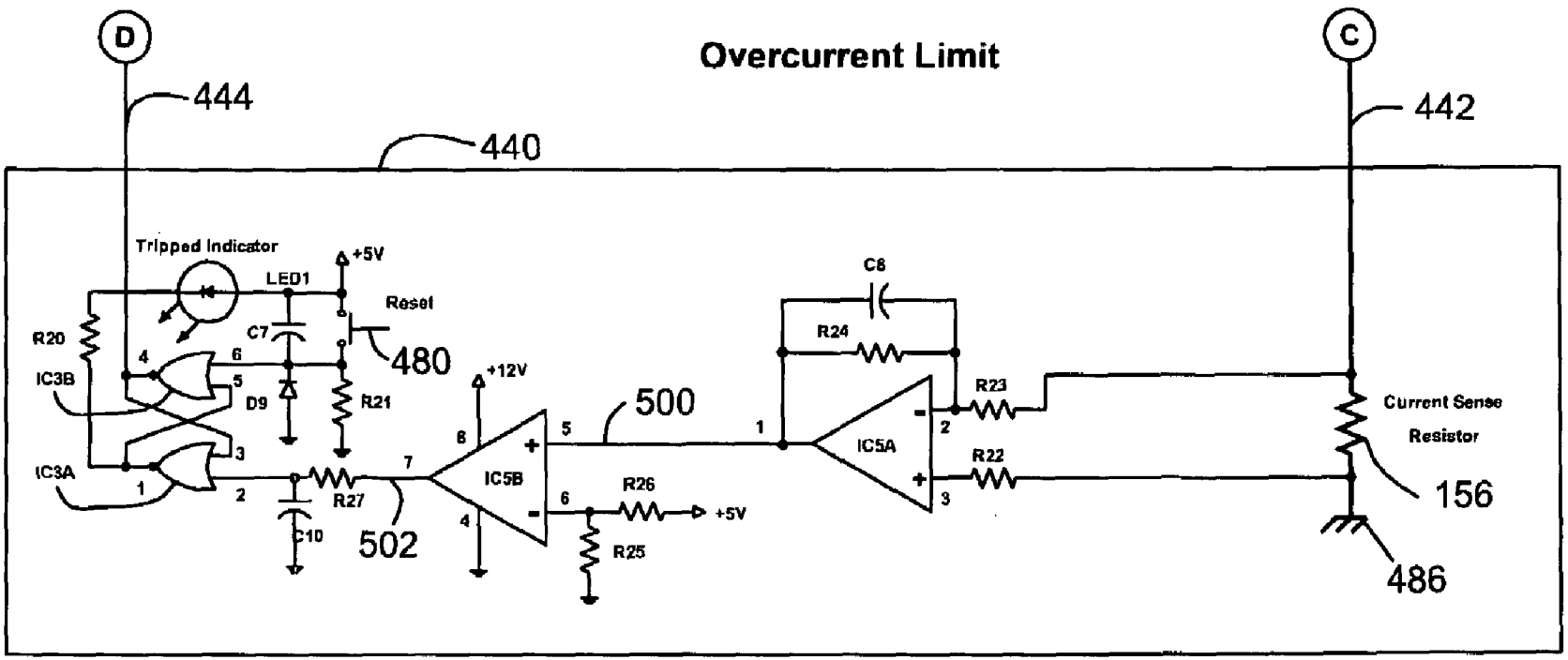
FIG. 11C is a schematic block diagram of the Overload Limiting circuitry.

FIG. 11C is a schematic block diagram of the Overload Limiting circuit.

FIG. 11A, FIG. 11B and FIG. 11C are interconnected at interconnection points A, B, C, and D and will be treated together without specific reference to specific FIG.'s in the following description.

Battery 450 is a deep cycle 12 volt battery and is protected by circuit breaker CB1. Battery 450 supplies electrical to power motor 126 and to all of the logic and control circuitry. The heavy lines indicate high current paths related to motor operation.

Voltage Regulator

The Voltage Regulator circuitry 432 utilizes voltage regulator circuit 1C1 to provide regulated +5 volts dc from the 12 volts dc battery power, and is utilized to power the electronic circuitry. Capacitor C1 is functional in the +12 volt dc supply and capacitor C2 is functional in the +5 volt dc supply. The solid-state circuits are powered by the +5 volts supply with respect to ground. Over-current and reverse voltage protection for the solid-state electronic circuitry is provided by diodes D1 and D13 and Resistor R1.

The control for raising or lowering the lifting structure 22 is accomplished by the Lifting Logic 408 in response 'Up' or 'Down' selections from Wired Remote 402 or from the Remote Receiver 410. Wire Remote 402 includes 'UP' switch 452 and 'DOWN' switch 454 for providing selection signals on lines 404 and 406, respectively. The Remote Receiver (Radio Receiver) 410 provides lamp selection signals on lines 422 and 424, and provides 'UP' and 'DOWN' selection signals on lines 412 and 414, respectively. Resistors R3, R4, R5, and R6 each serve to limit current flow to protect Remote Receiver 410. Resistor R7 provides a load for the +5 volt supply, thus preventing short circuit connections when either switch 452 or switch 454 is activated and thereby prevents shorting out the +5 volt supply. A collapse of the +5 volt supply would cause the electronic circuitry to become non-functional and would disable the lifting function.

Lighting Logic

The Lighting Logic 420 only receives activating signals form the Radio Receiver 410. A pair of D-type flip-flops IC2A and IC2B receive Lamp 1 and Lamp 2 selection signals, respectively, and are utilized to control light turn-on and light turn-off. Lines 456 and 458 connect the NOT Q output terminals to the D input terminals of the associated flip-flops, thereby causing the flip-flops to toggle upon sequential application of input signals on lines 422 and 424. This results in push-on and push-off functionality with respect to lamp operation. The Q output terminal of IC2A is coupled via resistor R12 to the gate of MOSFET Q3 and the Q output terminal of IC2B is coupled via resistor R13 to the gate of MOSFET Q4. Resistors R12 and R13 each provide voltage level adjustments to establish a bias level causing conduction of its associated MOSFET. When either or both MOSFET Q3 or Q4 are gated on, lamp current is passed and the selected associated Lamp 1 or Lamp 2, or both, is powered to light. Resistors R12 and R13 also function to protect IC2A and IC2B, respectively, from damage in the event of gate isolation failure of its associated MOSFET.

Timer circuit IC6 has an internal oscillator that controls a counter with a signal provided at its output Q14 when a predetermined count has occurred. The count is selected to represent a predetermined elapsed time, and is used for limiting the duration of time either Lamp 1 or Lamp 2 are allowed to be on. The initiation of timing occurs upon either or both IC2A or IC2B being set. The NOT Q terminals are coupled through Diodes D11 and D12. These Diodes function to isolate the NOT Q terminals from each other and provide a negative logic NOR at common point 460, which is coupled to the Reset terminal of IC6. Thus, when either of the NOT Q output terminals are low, thereby indicating the associated IC2A or IC2B has been set to turn a Lamp on, the Reset condition of IC6 is removed and triggers the start of the count down process. Upon completion of the countdown, a high signal is generated at output terminal Q14. The high signal operates through bias resistor R31 to bias Q5 into the conductive state to thereby resetting the flip-flops and turning either or both of the Lamps off. The reset timing is selected to provide sufficient time to operate the lift, walk to or from the lift, or combination thereof, before automatically turning the Lamps off. This automatic feature is provided as a safety feature and to prevent drain down of battery 450 in the event a user forgets to turn the Lamps off.

Power-up and power-down of the system requires additional protection of the Lighting Logic. At power-up resistor R2 and Capacitor C3 provide a time constant for the time necessary to charge Capacitor C3. Junction 462 is coupled to the NOT CLEAR input terminals of flip-flops IC2A and IC2B, at power-up so that connecting battery 450 into the circuit does not turn the Lamps on without application of a user command. At power-down, diode D2 discharges Capacitor C3 and protects the NOT CLEAR input terminals of the flip-flops.

Lifting Logic

The Lifting Logic 408 accepts 'UP' and 'DOWN' commands from the Wired Remote 402 on lines 404 and 406, respectively, and from the Remote Receiver 410 on lines 412 and 414, respectively. Since the Wired Remote 402 is exposed to the elements and may take on some moisture, resistors R32 and R33 provide loads to the extent that leakage currents occur due to moisture in the switches will not result in voltages of sufficient magnitude to cause activation of false commands to the lift. Diodes D3 and D5 form an OR function for the 'UP' commands to provide an activating signal at junction 470. Similarly, diodes D4 and D6 form an OR function of the 'DOWN' commands to provide an activating signal at junction 472. Resistors R8 and R9 each provide a path to ground and establish a voltage drop that establish signal levels to be provided to the solid state logic components IC4B and IC4A, respectively. Resistor R14 and R15 are current limiting devices and serve to protect the logic components from excessive voltage levels being applied thereto.

Three-input AND circuit IC4B provides an activating output signal through resistor RIO to the gate of MOSFET Q1. When gated on, Q1 provides the current path on line 416 to activate 'UP' solenoid 132. In a similar manner, three-input AND circuit IC4A provides an activating output signal through resistor R 1I to the gate of MOSFET Q2. When gated on, Q2 provides the current path on line 418 to activate 'DOWN' solenoid 134. The 'UP' selection signal is applied via line 474 to the A input of IC4B, and the 'DOWN' selection signal is applied via line 476 to the A input of IC4A.

The two-input NOR circuits IC3D and IC3C provide disabling signal in the event of conflicting 'UP' and 'DOWN' selections being provided at the same time or in the event a current overload is detected. The 'UP' signal is provided on line 474-1 as one input to NOR circuit IC3C, which in turn provides the inverted level signal to the B input of IC4A and will immediately result in its being switched to provide a disabling signal to Q2 irrespective of the state of the other input signals. If no 'UP' signal occurs at the same time as a 'DOWN' signal, IC4A will have its B input enabled by the inverted output of IC3C. In a similar manner, the 'DOWN' signal is provided on line 476-1 as one input to NOR circuit IC3D, which in turn provides the inverted signal to the B input of IC4B and will immediately result in its being switched to provide a disabling signal to Q1 irrespective of the state of the other input signal. If no 'DOWN' signal occurs at the same time an 'UP' signal, IC4B will have its B input enabled by the inverted output of IC3D.

When the Overload Limit 440 circuitry detects an overload condition for the motor, an activating signal will be provided on line 444 as the other input signals for the two-input NOR circuits IC3C and IC3D. The NOR circuits will provide the deactivate signal at their respective output terminal if either of the input signals is at an activating level. The Overload Limit circuitry will be described in more detail below.

It is apparent, then, that this circuitry inhibits conflicting operation that occurs when an 'UP' signal is applied at the same time as a 'DOWN' signal is applied, and inhibits operation when an overload condition is sensed. Both the conflicting lift signals and an overload condition could cause damage to the boatlift.

Another concern that arises in the operation of the boatlift occurs when a change of direction is signaled. The control circuitry provides a predetermined delay in applying direction-reversing signals to allow time for the motor and the lifting structure to stop. In addition to applying the output of NOR circuit IC3D to the B input of IC4B, the output is also connected to the C input through a network comprised of diode D7, resistors R16 and R17, and capacitor C5. Resistor R17 has a resistance value substantially greater that the resistance value of resistor R16 and with the inclusion of diode D7, an asymmetrical time constant is formed such that upon the output of IC3D going to the active state, current through resistor R17 causes capacitor C5 to take several seconds to charge to the threshold value to activate the C input to IC4B. This delay causes the 'UP' movement to be delayed or disallowed until the lift has had time to come to a stop following execution of a 'DOWN' function. The lower value of resistor R16 allows capacitor C5 to be discharged quickly so the delay will be available even when a brief inhibit condition has occurred. In a similar manner, a time delay to activating the C input of IC4A is accomplished by the network of diode D8, resistors R18 and R19, and capacitor C6. The Overload Limit 440 circuitry will be described in detail below, but it will be understood that the occurrence of the a signal on line 444 will subject the Lifting Logic to delay similar that occurring for change of direction of the lift. The current overload condition will cause the delay of reactivation for several seconds before lift movement is allowed, and will discourage a user from simply holding the reset switch 480 to defeat the overload protection.

An additional control feature is provided by limit switch LS3, which provides an alternative upper limit of lift travel short of the full travel of the lift. The user-set, up travel limit of LS3 is coupled through diode D10 to the network that is coupled to the C input of IC4B. It will be noted that LS3 is normally open and will be closed when the lift reaches the user-set lift position. Closure of LS3 causes capacitor C5 to rapidly discharge to ground through resistor R16, thereby forcing a disable condition at input C. This condition causes IC4B to immediately bias MOSFET Q1 off and disables line 416. Such a user-set, up travel limiting option is useful, for example when the boatlift has a canopy attached to cover the boatlift. A canopy could come in contact with the boat or a boat windshield if the full 'UP' range of travel of the lifting structure would be allowed. The user-set limit prevents lifting to the maximum allowable height of the lifting structure, and avoids the problem.

Motor Power Control

The Motor Power Control 434 performs the high current switching of the motor current and performs a dynamic braking function. The heavier lines indicate high current paths, as opposed to the logic circuitry. The battery 450 is a 12 volt deep cycle battery. The negative terminal of the battery 450 is coupled to ground 482 and through current-sense resistor 156 to motor ground 486. The positive terminal of battery 450 is 156 through circuit breaker CB1 to common line 488. 'UP' solenoid 132 includes a normally open contact, a normally closed contact, and an activation coil 490. Similarly, 'DOWN' solenoid 134 includes a normally open contact, a normally closed contact, and an activation coil 492. Motor 126 has its 'UP' terminal coupled to circuit junction 494 at 'UP' solenoid 132, and has its 'DOWN' terminal coupled via line 496 to one side of the normally open contact for 'DOWN' solenoid 134. Battery power from line 488 is applied to the normally open contacts for both solenoids 132 and 134. Terminals on the normally closed contacts of solenoids 132 and 134 are coupled together by line 498. The other terminal of the normally closed contact in solenoid 132 is coupled to junction 494, and the other normally closed contact in solenoid 134 is coupled through brake resistor 156 to motor ground.

Coil 490 of 'UP' solenoid 132 is coupled to line 416, and receives current flow from line 488 through diode D13 and through 'UP' limit switch 244 when MOSFET Q1 is biased to a conducting state indicative of selection of 'UP' movement of the lifting structure. When current flows in coil 490, it acts to switch solenoid 132 causing its normally closed contact to open and the normally closed contact to open, thereby applying the battery 450 power to the 'UP' terminal of motor 126. This application of battery power causes motor 126 to rotate drive shaft 128 in a direction to cause the lifting structure to be raised. Coil 492 of 'DOWN' solenoid 134 is coupled to line 418, and receives current flow through diode D13 and through 'DOWN' limit switch 246 when MOSFET Q2 is biased to a conducting state indicative of selection of 'DOWN' movement of the lifting structure. When current flows in coil 492, it acts to switch solenoid 134 causing its normally closed contact to open and the normally open contact to close, thereby applying battery 450 power to the 'DOWN' terminal of motor 126. This application of battery power causes motor 126 to rotate drive shaft 128 in a direction causing lowering of the lift structure.

It is of course understood that upon the lifting structure being raised to its predetermined maximum height or being lowered to a predetermined level, limit switch LS1 or limit switch LS2 will be opened, respectively. The opening of either limit switch will open its associated coil energizing path and will cause its associated solenoid to switch to its deactivated state. When deactivated, the solenoids remove power from motor 126.

The Motor Power Control 434 provides an auxiliary braking function when the lifting structure is raised and solenoids 132 and 134 are both deactivated. Under these conditions a circuit path is completed from the 'UP' terminal of motor 126 through both normally closed contacts and brake resistor 499 to motor ground. With the weight of the lifting structure applying reversing pressure on ball screw mechanism 36, the drive train mechanism operation is reversed from the lifting function and caused drive shaft 128 to be rotated. The rotation of drive shaft 128 causes motor 126 to act as a generator dispelling the current generated through the brake resistor 156 to ground. The back emf caused by the generator action causes a resistance to rotation of the drive shaft and provides the braking function.

Overload Limit

As noted above, it is desirable to detect overload of motor 126 during a lifting operation, and to provide a means to disable power to the motor when any such overload is detected. The motor current has a relationship to the load that is being lifted. The overcurrent limiting circuitry 440 senses motor current as a voltage drop across current sense resistor 156. Since the voltage drop can be amplified, the resistance value of resistor 156 can be small and will thereby minimize energy loss. The negative terminal of battery 450 is connected via line 442 to resistor 484, which in turn is connected to motor ground 486. While ground reference voltage is applied via resistor R22 to the non-inverting input of operational amplifier IC5A, the sensed voltage, now negative with respect to ground, is supplied through resistor R23 to its inverting input. Operational amplifier IC5A is of a type having an input structure configured to allow a common mode voltage range that includes ground. The negative feedback structure for IC5A includes resistor R24 for establishing the dc voltage gain and capacitor C8 for providing a low-pass response to remove initially high values of sensed voltage that occur during start up of the motor.

The output on line 500 from IC5A is a voltage level that represents the level of sensed motor current. This amplified low-pass motor current analogy is sent via line 500 to the non-inverting input of operational amplifier IC5B, where it is compared to a reference voltage. The reference voltage is provided at the network created by resistors R25 and R26, and the +5 volt supply. The reference voltage is applied to the inverting input of IC5B. Should the motor current analogy exceed the reference voltage, the output of IC5B on line 502 will swing toward the positive supply. IC3A and IC3B are each two-input NOR circuits and are cross-coupled to form a flip-flop. The output on line 502 is applied through resistor R27 to limit current into IC3A due to the supply voltage differences between IC3A and IC5B and will cause the flip-flop to be set. When set, the flip-flop will provide an overload indicating signal on line 444 to deactivate motor operation as previously described. The triggering output from IC3A will pass current through resistor R20 that will cause LED1 to become lit and thereby provides a visual indication that an overload condition has occurred. Resistor 20 limits the level of current applied to LED1. This tripped indicator will remain lit and the Lifting Logic 408 circuitry will remain deactivated until there is manual intervention through activation of the reset switch 480. The network comprised of diode D9, resistor R21, and capacitor C7 ensure that the circuit is reset a power-on; and, once tripped, that pressing the reset switch 480 will clear the disabled condition.

The logic described is positive logic with signals and component biases being positive with respect to ground. It is of course apparent that negative logic could equally as well be utilized with appropriate power supply requirements.

The electronic components are all available commercially and the component values can be determined for various types of power and load conditions by those skilled in the art, without departing from the inventive concepts.

From the drawings and the foregoing description of the preferred embodiment, it can be seen that the stated purposes and other more detailed and specific objectives of the invention have been achieved. Various modifications and extensions will become apparent to those skilled in the art within the spirit and scope of the invention. Accordingly, what is intended to be protected by Letters Patent is set forth in the appended claims.

The invention claimed is:

1. A powered boatlift comprising:

a plurality of support legs;

a boat lifting structure moveably mounted to said plurality of support legs;

a cable assembly having a connecting end and a lifting end connected in cooperation with said boat lifting structure for causing said boat lifting structure to be raised or lowered;

an electric drive unit having a drive shaft capable of rotating in a first direction in response to a first input signal or rotating in a second direction in response to a second input signal;

a drive coupling structure coupled to said drive shaft;

a ball screw assembly having a first portion coupled to said coupling structure and a second portion coupled to said connecting end;

wherein said first portion of said ball screw assembly includes an elongated ball screw having a driving end coupled to said coupling structure wherein said coupling structure rotatably supports said driving end; and said second portion of said ball screw assembly includes a ball nut associated with said elongated ball screw, said ball screw having a cable connection coupled to said connecting end of said cable assembly; and wherein said drive coupling structure includes:

a drive train assembly having an input drive coupled to said drive shaft for receiving high-speed low-torque input from said electric drive unit;

a torque conversion mechanism coupled to said input drive for converting said high-speed low-torque input to a low-speed high-torque output at an output drive; and an output coupling intermediate said output drive of said torque conversion mechanism and said driving end of said elongated ball screw.

2. A powered boatlift as in claim 1, wherein said torque conversion mechanism includes:

a speed-reducing structure driven by said input drive and having an output drive shaft; and a torque-increasing structure driven by said output drive shaft and coupled to said output coupling.

3. A powered boatlift as in claim 2, wherein said speed-reducing structure is a pulley assembly and is belt driven; and said torque-increasing structure is a gear assembly and is chain driven.

4. A powered boatlift as in claim 1, wherein said torque conversion mechanism includes:

a first drive pulley having a first predetermined diameter coupled to said input drive;

a pulley drive shaft having a driven end and a driving end;

a second drive pulley having a second predetermined diameter larger than said first predetermined diameter, said second drive pulley rotatably supported by said pulley drive shaft at said driven end;

a belt intercoupling said first drive pulley and said second drive pulley;

a first drive gear having a third predetermined diameter mounted on said driving end of said pulley drive shaft;

a gear drive shaft having a driven end and a driving end;

a second drive gear having a fourth predetermined diameter larger than said third predetermined diameter, said first drive gear rotatably supported by said gear drive shaft at said driven end;

a chain intercoupling said first drive gear and said second drive gear; and an output coupling intercoupling said driving end of said gear drive shaft and said driving end of said elongated ball screw.

5. A boatlift structure as in claim 4, wherein a first ratio of said first predetermined diameter to said second predetermined diameter establishes a predetermined speed reduction at said pulley drive shaft; and a second ratio of said third predetermined diameter to said fourth predetermined diameter establishes a predetermined torque increase at said output coupling.

6. A powered boatlift structure as in claim 1, and further including a lift movement limiting mechanism comprising:

a lift measuring mechanism capable of determining the extent of upward and downward movement of said lifting structure;

a first disabling structure coupled to said lift measuring mechanism to disable power to said electric drive unit when said lift measuring mechanism determines that a predetermined permissible upward movement of said lifting structure has been achieved; and a second disabling structure coupled to said lift measuring mechanism to disable power to said electric drive unit when said lift measuring mechanism determines that a predetermined permissible downward movement of said lifting structure has been achieved.

7. A powered boatlift structure as in claim 1, wherein said electric drive unit includes:

a reversible electric motor; and a control circuit coupled to said electric motor to selectively control the direction of rotation or said electric motor in response to said first signal and said second signal.

8. A powered boatlift structure as in claim 7, wherein said control circuit includes:

a load limit detecting circuit to provide a disabling signal to disable application of power to said reversible electric motor when electrical current flow to said reversible electric motor is detected to be in excess of a predetermined permissible level.

9. A power boatlift structure as in claim 8, and further including:

a manual reset actuator coupled to said control circuit to enable operation of said control circuit after a said disabling signal has been provided by said load circuit detecting circuit.

10. A powered boatlift structure as in claim 7, wherein said control circuit includes:

a first manually operable switch to provide said first signal to apply electrical circuit to said reversible electric motor to cause rotation in a first direction; and a second manually operable switch to provide said second signal to apply electrical current to said reversible electric motor to cause rotation in a second direction.

11. A powered boatlift structure as in claim 7, wherein said control circuit includes a receiver circuit responsive to a first remote signal to provide said first signal to apply electrical current to said reversible electric motor to cause rotation in a first direction; and responsive to a second remote signal to provide said second signal to apply electrical current to said reversible electric motor to cause rotation in a second direction.

12. A powered boatlift structure as in claim 7, wherein said control circuit includes:

a first switch to provide said first signal;

a second switch to provide said second signal;

a receiver responsive to a first remote signal to protect said first signal and responsive to a second remote signal to provide said second signal.

13. A powered boatlift structure as in claim 7, wherein said control circuit includes:

a reversal delay circuit to delay application of said first signal or said second signal by a predetermined delay time interval to delay reversal of rotation of said reversible electric motor.

14. A powered boatlift structure as in claim 1, and further including:

a brake mechanism for holding said boat lifting structure in place when said electric device unit does not have electrical current applied.

15. A powered boatlift structure as in claim 1, wherein one or more of said plurality of support legs includes a boatlift leveling mechanism.

16. A powered boatlift structure as in claim 15, wherein said boatlift leveling mechanism includes:

a footpad;

a height adjustment mechanism for use in colinear alignment with an associated boatlift leg and having a first end portion coupled to said footpad and having a second end portion; and a height adjustment actuator accessible along an associated one of said plurality of boatlift legs and coupled to said second end portion at a predetermined angle with respect to said alignment, whereby the relationship of said footpad with respect to an associated one of said plurality boatlift legs can be controlled.

17. A boatlift leveling mechanism as in claim 16, wherein said height adjustment mechanism includes:

a leg extension member having said first end portion and said second end portion;

a height adjusting screw mechanism in cooperation with said leg extension member, said height adjusting screw mechanism including an elongated screw having an activating end and having a screw nut coupled to said leg extension member; and an affixed bevel gear coupled to said activating end, whereby said leg extension member is caused to move with respect to an associated boatlift leg when said height adjusting screw mechanism is activated by rotation of said affixed bevel gear.

18. A boatlift leveling mechanism as in claim 17, wherein said height adjustment mechanism further includes:

a height adjustment actuator having a mating bevel gear in cooperation with said affixed bevel gear and having a height adjustment actuator for causing said mating bevel gear to impart rotational movement to said affixed bevel gear, whereby said screw is caused to rotate and move said screw nut long the length of said screw.

19. For use with a boatlift having at least one boatlift leg, a boatlift leveling mechanism comprising:

a footpad;

a height adjustment mechanism for use in colinear alignment with an associated boatlift leg and having a first end portion coupled to said footpad and having a second end portion; and a height adjustment actuator accessible along an associated boatlift leg and coupled to said second end portion at a predetermined angle with respect to said alignment, wherein said height adjustment mechanism includes:

a leg extension member having said first end portion and said second end portion;

a height adjusting screw mechanism in cooperation with said leg extension member, said height adjusting screw mechanism including an elongated screw having an activating end and having a screw nut coupled to said leg extension member; and an affixed bevel gear coupled to said activating end, whereby said leg extension member is caused to move with respect to an associated boatlift leg when said screw mechanism is activated by rotation of said affixed bevel gear.

20. A boatlift leveling mechanism as in claim 19 wherein said leg extension member further comprises:

an elongate structure having a predetermined length longer than the length of said screw mechanism, said elongated structure capable of slidable engagement with at least a portion of an associated boatlift leg, and said elongated structure having a predetermined tubular cross-section, wherein said screw mechanism is positioned within at least a portion of the tubular opening.

21. A boatlift leveling mechanism as in claim 19, wherein said height adjustment mechanism further includes:

a height adjustment actuator having a mating bevel gear in cooperation with said affixed bevel gear and having a height adjustment actuator for causing said mating bevel gear to impart rotational movement to said affixed bevel gear, whereby said screw is caused to rotate and move said screw nut long the length of said screw.

22. A boatlift leveling mechanism as in claim 21, wherein said height adjustment actuator further includes:

a shaped head that is accessible along a boatlift leg; and a shaft having a first shaft end coupled to said shaped head and a second shaft end coupled to said mating bevel gear, whereby said leg extension member is caused to be moved in a first direction when said mating bevel gear is rotated in a first direction and in a second direction when said mating bevel gear is rotated in a second direction be selective activation of rotation of said shaped head in a first rotation direction or in a second rotation direction, respectively.

23. A boatlift leveling mechanism as in claim 22, wherein said shaft is oriented substantially perpendicular to said elongated screw.

24. A boatlift leveling mechanism as in claim 22 and further including:

a bracket having a first structure to hold said mating bevel gear in a rotatable cooperative relation with said affixed bevel gear and having a second structure for coupling said bracket to a boatlift leg.

* * * * *